US010408047B2

(12) United States Patent
Morrow

(10) Patent No.: US 10,408,047 B2
(45) **Date of Patent: *Sep. 10, 2019**

(54) REAL-TIME WELL SURVEILLANCE USING A WIRELESS NETWORK AND AN IN-WELLBORE TOOL

(71) Applicant: ExxonMobil Upstream Research Company, Spring, TX (US)

(72) Inventor: Timothy I. Morrow, Humble, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 324 days.

This patent is subject to a terminal disclaimer.

(21) Appl. No.: 14/921,374

(22) Filed: Oct. 23, 2015

(65) Prior Publication Data

US 2016/0215612 A1 Jul. 28, 2016

Related U.S. Application Data

(60) Provisional application No. 62/107,900, filed on Jan. 26, 2015.

(51) Int. Cl.

| | |
|---|---|
| ***E21B 47/12*** | (2012.01) |
| ***E21B 47/01*** | (2012.01) |
| ***E21B 47/16*** | (2006.01) |

(52) U.S. Cl.

CPC ..... *E21B 47/122* (2013.01); *E21B 47/01* (2013.01); *E21B 47/011* (2013.01); *E21B 47/16* (2013.01)

(58) Field of Classification Search

CPC ..... E21B 47/122; E21B 47/011; E21B 47/01; E21B 47/16

See application file for complete search history.

(56) References Cited

U.S. PATENT DOCUMENTS

| | | | | |
|---|---|---|---|---|
| 3,103,643 | A | 9/1963 | Kalbfell | 340/17 |
| 3,205,477 | A | 9/1965 | Kalbfell | 340/18 |

(Continued)

FOREIGN PATENT DOCUMENTS

| | | | |
|---|---|---|---|
| CN | 102733799 | 6/2014 | E21B 47/16 |
| EP | 0 636 763 A2 | 2/1995 | |

(Continued)

OTHER PUBLICATIONS

Emerson Process Management (2011), "Roxar downhole Wireless PT sensor system," www.roxar.com, or downhole@roxar.com, 2 pgs.

(Continued)

*Primary Examiner* — Amine Benlagsir

(74) *Attorney, Agent, or Firm* — ExxonMobil Upstream Research Company-Law Department

(57) ABSTRACT

A method of transmitting data in a wellbore uses a signal receiver that is run into the wellbore on a working string. The signal receiver receives wireless signals from receiver communications nodes placed along the wellbore. The data from those signals is then sent up the wellbore, either by directing the signals directly up the working string, or by spooling the string to the surface and uploading the data. Sensors and associated communications nodes are placed within the wellbore to collect data. The communications nodes may be the signal receiver nodes; alternatively, the communications nodes may send data from the sensors up the wellbore through acoustic signals to a receiver communications node. In the latter instance, intermediate communications nodes having electro-acoustic transducers are used as part of a novel telemetry system.

40 Claims, 8 Drawing Sheets

(56) References Cited

U.S. PATENT DOCUMENTS 3,512,407 A 5/1970 Zill ..... 73/152
3,637,010 A 1/1972 Malay et al. ..... 166/51
3,741,301 A 6/1973 Malay et al. ..... 166/191
3,781,783 A 12/1973 Tucker ..... 340/18
3,790,930 A 2/1974 Lamel et al. ..... 340/18
3,900,827 A 8/1975 Lamel et al. ..... 340/18
3,906,434 A 9/1975 Lamel et al. ..... 340/18
4,001,773 A 1/1977 Lamel et al. ..... 340/18
4,283,780 A 8/1981 Nardi ..... 367/82
4,298,970 A 11/1981 Shawhan et al. ..... 367/82
4,302,826 A 11/1981 Kent et al. ..... 367/82
4,314,365 A 2/1982 Peterson et al.
4,884,071 A 11/1989 Howard
4,962,489 A 10/1990 Medlin et al. ..... 367/32
5,128,901 A 7/1992 Drumheller
5,136,613 A 8/1992 Dumestre, III ..... 375/1
5,166,908 A 11/1992 Montgomery ..... 367/165
5,182,946 A 2/1993 Boughner et al. ..... 73/151
5,234,055 A 8/1993 Cornette
5,283,768 A 2/1994 Rorden ..... 367/83
5,373,481 A 12/1994 Orban et al. ..... 367/82
5,468,025 A 11/1995 Adinolfe et al. ..... 285/114
5,480,201 A 1/1996 Mercer
5,495,230 A 2/1996 Lian
5,562,240 A 10/1996 Campbell
5,592,438 A 1/1997 Rorden et al.
5,667,650 A 9/1997 Face et al. ..... 204/298.07
5,850,369 A 12/1998 Rorden et al.
5,857,146 A 1/1999 Kido ..... 455/38.3
5,924,499 A 7/1999 Birchak et al.
5,960,883 A 10/1999 Tubel et al. ..... 166/313
5,995,449 A 11/1999 Green et al.
6,049,508 A 4/2000 Deflandre
6,125,080 A 9/2000 Sonnenschein et al. ..... 367/134
6,128,250 A * 10/2000 Reid ..... B06B 1/0633 367/153
6,177,882 B1 1/2001 Ringgenberg et al. .... 340/853.7
6,236,850 B1 5/2001 Desai ..... 455/343
6,239,690 B1 5/2001 Burbidge et al. ..... 340/10.33
6,300,743 B1 10/2001 Patino et al. ..... 320/106
6,320,820 B1 11/2001 Gardner et al. ..... 367/81
6,324,904 B1 12/2001 Ishikawa et al. ..... 73/152.03
6,394,184 B2 5/2002 Tolman et al. ..... 166/281
6,400,646 B1 6/2002 Shah et al. ..... 367/82
6,429,784 B1 8/2002 Beique et al.
6,462,672 B1 10/2002 Besson
6,543,538 B2 4/2003 Tolman et al. ..... 166/284
6,670,880 B1 12/2003 Hall et al.
6,695,277 B1 2/2004 Gallis
6,702,019 B2 3/2004 Dusterhoft et al. ..... 166/278
6,717,501 B2 4/2004 Hall et al.
6,727,827 B1 4/2004 Edwards et al. ..... 340/854.9
6,772,837 B2 8/2004 Dusterhoft et al. ..... 166/278
6,816,082 B1 11/2004 Laborde
6,868,037 B2 3/2005 Dasgupta et al.
6,883,608 B2 4/2005 Parlar et al. ..... 166/278
6,899,178 B2 5/2005 Tubel
6,909,667 B2 6/2005 Shah et al. ..... 367/83
6,912,177 B2 6/2005 Smith
6,920,085 B2 7/2005 Finke et al. ..... 367/83
6,930,616 B2 8/2005 Tang et al. ..... 340/854.4
6,940,392 B2 9/2005 Chan et al. ..... 340/10.4
6,940,420 B2 9/2005 Jenkins ..... 340/855.6
6,953,094 B2 10/2005 Ross et al. ..... 166/381
6,956,791 B2 10/2005 Dopf et al.
6,980,929 B2 12/2005 Aronstam et al.
6,987,463 B2 1/2006 Beique et al.
7,006,918 B2 2/2006 Economides et al.
7,011,157 B2 3/2006 Costley et al. ..... 166/311
7,051,812 B2 5/2006 McKee et al. ..... 166/305.1
7,064,676 B2 6/2006 Hall et al.
7,082,993 B2 8/2006 Ayoub et al.
7,140,434 B2 11/2006 Chouzenoux et al.
7,224,288 B2 5/2007 Hall et al.
7,228,902 B2 6/2007 Oppelt ..... 166/250.02
7,249,636 B2 7/2007 Ohmer
7,257,050 B2 8/2007 Stewart et al.
7,261,162 B2 8/2007 Deans et al. ..... 166/336
7,275,597 B2 10/2007 Hall et al. ..... 166/297
7,277,026 B2 10/2007 Hall et al.
RE40,032 E 1/2008 van Borkhorst et al. ..... 455/343.2
7,317,990 B2 1/2008 Sinha et al.
7,321,788 B2 1/2008 Addy et al. ..... 455/574
7,322,416 B2 1/2008 Burris, II et al. ..... 166/308.1
7,325,605 B2 2/2008 Fripp et al. ..... 166/250.01
7,348,893 B2 3/2008 Huang et al.
7,385,523 B2 6/2008 Thomeer et al. ..... 340/854.8
7,411,517 B2 8/2008 Flanagan
7,477,160 B2 1/2009 Lemenager et al.
7,516,792 B2 4/2009 Lonnes et al.
7,551,057 B2 6/2009 King et al. ..... 340/5.72
7,590,029 B2 9/2009 Tingley ..... 367/82
7,595,737 B2 9/2009 Fink et al.
7,602,668 B2 10/2009 Liang et al.
7,649,473 B2 1/2010 Johnson et al.
7,750,808 B2 7/2010 Masino et al. ..... 340/572.1
7,775,279 B2 8/2010 Marya et al.
7,787,327 B2 8/2010 Tang et al. ..... 367/27
7,831,283 B2 11/2010 Ogushi et al. ..... 455/574
7,952,487 B2 5/2011 Montebovi ..... 340/636.1
8,004,421 B2 8/2011 Clark ..... 340/854.4
8,044,821 B2 10/2011 Mehta
8,049,506 B2 11/2011 Lazarev
8,115,651 B2 2/2012 Camwell et al.
8,117,907 B2 2/2012 Han et al. ..... 73/152.58
8,162,050 B2 4/2012 Roddy et al.
8,220,542 B2 7/2012 Whitsitt et al.
8,237,585 B2 8/2012 Zimmerman
8,242,928 B2 8/2012 Prammer
8,276,674 B2 10/2012 Lopez de Cardenas et al. ..... 166/373
8,330,617 B2 12/2012 Chen et al.
8,347,982 B2 1/2013 Hannegan et al.
8,376,065 B2 2/2013 Teodorescu et al. ..... 175/40
8,381,822 B2 2/2013 Hales et al.
8,388,899 B2 3/2013 Mitani et al. ..... 422/179
8,434,354 B2 5/2013 Crow et al.
8,496,055 B2 7/2013 Mootoo et al.
8,539,890 B2 9/2013 Tripp et al.
8,544,564 B2 10/2013 Moore et al.
8,559,272 B2 10/2013 Wang
8,596,359 B2 12/2013 Grigsby et al. ..... 166/278
8,605,548 B2 12/2013 Froelich ..... 367/82
8,607,864 B2 12/2013 Mcleod et al. ..... 166/250.1
8,675,779 B2 3/2014 Zeppetelle et al. ..... 375/340
8,683,859 B2 4/2014 Godager
8,689,621 B2 4/2014 Godager
8,787,840 B2 7/2014 Srinivasan et al. ..... 455/69
8,805,632 B2 8/2014 Coman et al. ..... 702/89
8,826,980 B2 9/2014 Neer
8,833,469 B2 9/2014 Purkis
8,893,784 B2 11/2014 Abad ..... E21B 43/26
8,910,716 B2 12/2014 Newton et al. ..... 166/373
8,994,550 B2 3/2015 Millot et al. ..... E21B 47/16
8,995,837 B2 3/2015 Mizuguchi et al. ... H04B 10/27
9,062,508 B2 6/2015 Huval et al. ..... E21B 47/122
9,062,531 B2 6/2015 Jones ..... E21B 47/082
9,078,055 B2 7/2015 Nguyen et al. ..... H04R 5/00
9,091,153 B2 7/2015 Yang et al. ..... E21B 47/12
9,140,097 B2 9/2015 Themig et al. ..... E21B 34/12
9,144,894 B2 9/2015 Barnett et al. ..... B25B 17/00
9,206,645 B2 12/2015 Hallundbaek ..... E21B 7/04
9,284,819 B2 3/2016 Tolman et al. ..... E21B 41/00
9,284,834 B2 3/2016 Alteirac et al. ..... E21B 47/12
9,333,350 B2 5/2016 Rise et al. ..... A61N 1/36082
9,359,841 B2 6/2016 Hall ..... E21B 23/00
9,363,605 B2 6/2016 Goodman et al. ..... H04R 17/00
9,441,470 B2 9/2016 Guerrero et al. ..... E21B 43/14
9,515,748 B2 12/2016 Jeong et al. ..... G10L 25/90
9,557,434 B2 1/2017 Keller et al. ..... G01V 1/52
9,617,850 B2 4/2017 Fripp et al. ..... E21B 47/18
9,631,485 B2 4/2017 Keller et al. ..... E21B 47/16
9,657,564 B2 5/2017 Stolpman ..... E21B 47/16

(56) References Cited

U.S. PATENT DOCUMENTS 9,664,037 B2 5/2017 Logan et al. ..... E21B 47/122
9,670,773 B2 6/2017 Croux ..... E21B 47/16
9,683,434 B2 6/2017 Machocki ..... E21B 44/00
9,715,031 B2 7/2017 Contant et al. ..... E21B 47/122
9,721,448 B2 8/2017 Wu et al. ..... G08B 21/20
9,759,062 B2 9/2017 Deffenbaugh et al. ..... E21B 47/16
9,816,373 B2 11/2017 Howell et al. ..... E21B 47/16
9,822,634 B2 11/2017 Gao ..... E21B 47/16
9,863,222 B2 1/2018 Morrow et al. ..... E21B 43/122
9,879,525 B2 1/2018 Morrow et al. ..... E21B 47/12
9,963,955 B2 5/2018 Tolman et al. ..... E21B 43/119
10,100,635 B2 10/2018 Keller et al. ..... E21B 47/18
10,103,846 B2 10/2018 van Zelm et al. ..... E21B 47/12
10,132,149 B2 11/2018 Morrow et al. ..... E21B 43/267
10,145,228 B2 12/2018 Yarus et al. ..... E21B 44/00
10,167,716 B2 1/2019 Clawson et al. ..... E21B 47/14
10,167,717 B2 1/2019 Deffenbaugh et al. ..... E21B 47/16
10,190,410 B2 1/2019 Clawson et al. ..... E21B 47/14
10,196,862 B2 2/2019 Li-Leger et al. ..... E21B 17/02
2002/0026958 A1 3/2002 Brisco
2002/0043369 A1 4/2002 Vinegar et al.
2002/0180613 A1 12/2002 Shi et al. ..... E21B 47/18
2003/0056953 A1 3/2003 Tumlin et al.
2003/0117896 A1 6/2003 Sakuma et al. ..... 367/81
2004/0020063 A1* 2/2004 Lewis ..... E21B 47/01 33/313
2004/0065443 A1 4/2004 Berg et al.
2004/0073370 A1 4/2004 Dasgupta et al.
2004/0084190 A1 5/2004 Hill et al.
2004/0105342 A1 6/2004 Gardner et al.
2004/0200613 A1 10/2004 Fripp et al. ..... 166/250.01
2004/0239521 A1 12/2004 Zierolf ..... 340/854.1
2004/0256113 A1 12/2004 LoGiudice et al.
2005/0024231 A1 2/2005 Fincher et al.
2005/0039912 A1 2/2005 Hall et al.
2005/0145010 A1 7/2005 Vanderveen et al.
2005/0269083 A1 12/2005 Burris, II et al. ..... 166/255.2
2005/0284659 A1 12/2005 Hall et al.
2006/0002232 A1 1/2006 Shah et al.
2006/0033638 A1 2/2006 Hall et al. ..... 340/854.6
2006/0041795 A1 2/2006 Gabelmann et al. ..... 714/699
2006/0090893 A1 5/2006 Sheffield ..... 166/250.15
2006/0115095 A1 6/2006 Giesbrecht et al.
2006/0124310 A1 6/2006 Lopez de Cardenas et al.
2006/0133203 A1 6/2006 James et al.
2007/0024464 A1 2/2007 Lemenager et al.
2007/0029112 A1 2/2007 Li et al.
2007/0030762 A1 2/2007 Huang et al.
2007/0139217 A1 6/2007 Beique et al.
2007/0146351 A1 6/2007 Katsurahira et al. ..... 345/179
2007/0156359 A1 7/2007 Varsamis et al. ..... 702/69
2007/0219758 A1 9/2007 Bloomfield ..... 702/190
2007/0272411 A1 11/2007 Lopez de Cardenas et al. ..... 166/305.1
2008/0030365 A1 2/2008 Fripp et al. ..... E21B 47/16
2008/0110644 A1* 5/2008 Howell ..... E21B 17/028 166/387
2008/0185144 A1 8/2008 Lovell ..... 166/250.17
2008/0304360 A1 12/2008 Mozer ..... 367/117
2009/0003133 A1 1/2009 Dalton et al. ..... 367/82
2009/0030614 A1 1/2009 Carnegie et al. ..... 702/6
2009/0034368 A1 2/2009 Johnson ..... 367/83
2009/0045974 A1 2/2009 Patel
2009/0080291 A1 3/2009 Tubel et al. ..... 367/81
2009/0159272 A1 6/2009 Auzerais et al.
2009/0166031 A1 7/2009 Hernandez ..... 166/250.01
2009/0277688 A1 11/2009 Oothoudt
2009/0289808 A1 11/2009 Prammer
2010/0013663 A1 1/2010 Cavender et al.
2010/0089141 A1 4/2010 Rioufol et al. ..... 73/152.28
2010/0126718 A1 5/2010 Lilley
2010/0133004 A1 6/2010 Burleson et al. ..... 175/2
2010/0157739 A1 6/2010 Slocum et al.
2010/0176813 A1 7/2010 Simon
2010/0182161 A1 7/2010 Robbins et al. ..... 340/853.7
2010/0194584 A1 8/2010 Savage
2010/0212891 A1 8/2010 Stewart et al. ..... 166/250.12
2011/0061862 A1 3/2011 Loretz et al. ..... 166/250.11
2011/0066378 A1 3/2011 Lerche et al.
2011/0168403 A1 7/2011 Patel
2011/0186290 A1 8/2011 Roddy et al.
2011/0188345 A1 8/2011 Wang ..... 367/34
2011/0192597 A1* 8/2011 Roddy ..... E21B 33/13 166/253.1
2011/0275313 A1 11/2011 Baldemair et al.
2011/0280294 A1 11/2011 Luo et al.
2011/0297376 A1 12/2011 Holderman et al.
2011/0297673 A1 12/2011 Zbat et al. ..... 219/756
2011/0301439 A1 12/2011 Albert et al. ..... 600/301
2011/0315377 A1 12/2011 Rioufol ..... 166/250.17
2012/0017673 A1 1/2012 Godager
2012/0024050 A1 2/2012 Godager
2012/0024052 A1 2/2012 Eriksen
2012/0043079 A1 2/2012 Wassouf et al.
2012/0090687 A1 4/2012 Grisby et al.
2012/0126992 A1 5/2012 Rodney et al. ..... 340/850
2012/0152562 A1* 6/2012 Newton ..... E21B 43/12 166/369
2012/0170410 A1 7/2012 Hay
2012/0179377 A1 7/2012 Lie ..... 702/6
2012/0241172 A1 9/2012 Ludwig et al.
2012/0249338 A1* 10/2012 Merino ..... H04B 11/00 340/854.6
2012/0256415 A1* 10/2012 Dole ..... F16L 17/04 285/337
2012/0256492 A1 10/2012 Song et al.
2012/0257475 A1 10/2012 Luscombe et al.
2013/0000981 A1 1/2013 Grimmer et al. ..... 175/45
2013/0003503 A1 1/2013 L'Her et al. ..... 367/106
2013/0008648 A1 1/2013 Lovorn et al.
2013/0106615 A1 5/2013 Prammer
2013/0110402 A1 5/2013 Godager
2013/0138254 A1* 5/2013 Seals ..... E21B 23/08 700/282
2013/0175094 A1 7/2013 Ross et al.
2013/0192823 A1 8/2013 Barrilleaux et al. ..... 166/250.01
2013/0248172 A1 9/2013 Angeles Boza et al.
2013/0248174 A1 9/2013 Dale et al.
2013/0278432 A1 10/2013 Shashoua et al. ..... 340/853.7
2013/0319102 A1 12/2013 Riggenberg et al. ..... 73/152.28
2014/0060840 A1* 3/2014 Hartshorne ..... C09K 8/685 166/300
2014/0062715 A1 3/2014 Clark ..... 340/853.2
2014/0102708 A1* 4/2014 Purkis ..... E21B 43/26 166/308.1
2014/0133276 A1* 5/2014 Volker ..... E21B 47/16 367/82
2014/0152659 A1 6/2014 Davidson et al.
2014/0153368 A1 6/2014 Bar-Cohen et al. ..... 367/81
2014/0166266 A1 6/2014 Read ..... 166/250.01
2014/0170025 A1 6/2014 Weiner et al. ..... 422/82.01
2014/0266769 A1 9/2014 van Zelm
2014/0327552 A1 11/2014 Filas et al.
2014/0352955 A1 12/2014 Tubel et al.
2015/0003202 A1 1/2015 Palmer et al.
2015/0009040 A1 1/2015 Bowles et al.
2015/0027687 A1 1/2015 Tubel
2015/0041124 A1 2/2015 Rodriguez ..... 166/255.1
2015/0041137 A1 2/2015 Rodriguez ..... 166/301
2015/0152727 A1 6/2015 Fripp et al. ..... E21B 47/14
2015/0159481 A1 6/2015 Mebarkia et al. .... E21B 47/065
2015/0167425 A1 6/2015 Hammer et al. ..... E21B 34/06
2015/0176370 A1 6/2015 Greening et al. ..... E21B 41/00
2015/0292319 A1 10/2015 Disko et al. ..... E21B 47/16
2015/0292320 A1 10/2015 Lynk et al. ..... E21B 47/16
2015/0300159 A1 10/2015 Stiles et al. ..... E21B 47/16
2015/0330200 A1 11/2015 Richard et al. ..... E21B 44/00
2015/0337642 A1 11/2015 Spacek ..... E21B 44/005
2015/0354351 A1 12/2015 Morrow et al. ..... E21B 47/16
2015/0377016 A1 12/2015 Ahmad ..... E21B 47/122

(56) References Cited

U.S. PATENT DOCUMENTS

| | | | | |
|---|---|---|---|---|
| 2016/0010446 | A1 | 1/2016 | Logan et al. | E21B 47/122 |
| 2016/0047230 | A1 | 2/2016 | Livescu et al. | E21B 47/10 |
| 2016/0047233 | A1 | 2/2016 | Butner et al. | E21B 47/12 |
| 2016/0076363 | A1 | 3/2016 | Morrow et al. | E21B 47/12 |
| 2016/0109606 | A1 | 4/2016 | Market et al. | G01V 1/50 |
| 2016/0215612 | A1 | 7/2016 | Morrow | E21B 47/122 |
| 2017/0138185 | A1 | 5/2017 | Saed et al. | E21B 47/16 |
| 2017/0145811 | A1 | 5/2017 | Robison et al. | E21B 47/0007 |
| 2017/0152741 | A1 | 6/2017 | Park et al. | E21B 47/123 |
| 2017/0167249 | A1 | 6/2017 | Lee et al. | E21B 47/14 |
| 2017/0204719 | A1 | 7/2017 | Babakhani | E21B 47/0005 |
| 2017/0254183 | A1 | 9/2017 | Vasques et al. | E21B 47/16 |
| 2017/0293044 | A1 | 10/2017 | Gilstrap et al. | G01V 1/50 |
| 2017/0314386 | A1 | 11/2017 | Orban | E21B 47/091 |
| 2018/0058191 | A1 | 3/2018 | Romer et al. | E21B 47/0007 |
| 2018/0058198 | A1 | 3/2018 | Ertas et al. | E21B 47/12 |
| 2018/0058202 | A1 | 3/2018 | Disko et al. | E21B 47/14 |
| 2018/0058203 | A1 | 3/2018 | Clawson et al. | E21B 47/14 |
| 2018/0058204 | A1 | 3/2018 | Clawson et al. | E21B 47/14 |
| 2018/0058205 | A1 | 3/2018 | Clawson et al. | E21B 47/14 |
| 2018/0058206 | A1 | 3/2018 | Zhang et al. | E21B 47/16 |
| 2018/0058207 | A1 | 3/2018 | Song et al. | E21B 47/16 |
| 2018/0058208 | A1 | 3/2018 | Song et al. | E21B 47/16 |
| 2018/0058209 | A1 | 3/2018 | Song et al. | E21B 47/16 |
| 2018/0066490 | A1 | 3/2018 | Kjos | E21B 33/035 |
| 2018/0066510 | A1 | 3/2018 | Walker et al. | E21B 47/011 |

FOREIGN PATENT DOCUMENTS

| | | | | |
|---|---|---|---|---|
| EP | 1 409 839 | B1 | 4/2005 | |
| EP | 2677698 | | 12/2013 | H04L 12/28 |
| WO | WO2002/027139 | | 4/2002 | E21B 43/12 |
| WO | WO 2010/074766 | A1 | 7/2010 | |
| WO | WO 2013/079928 | A2 | 6/2013 | |
| WO | WO 2013/079929 | A2 | 6/2013 | |
| WO | WO 2013/112273 | A2 | 8/2013 | |
| WO | WO 2014/018010 | A1 | 1/2014 | |
| WO | WO 2014/049360 | A2 | 4/2014 | |
| WO | WO2014/100271 | | 6/2014 | E21B 47/12 |
| WO | WO 2014/134741 | A1 | 9/2014 | |
| WO | WO2015/117060 | | 8/2015 | E21B 47/12 |

OTHER PUBLICATIONS

U.S. Appl. No. 15/666,334, filed Aug. 1, 2017, Walker, Katie M. et al.
U.S. Appl. No. 16/139,373, filed Sep. 24, 2018, Yi, Xiaohua et al.
U.S. Appl. No. 16/139,384, filed Oct. 13, 2017, Disko, Mark M. et al.
U.S. Appl. No. 16/139,394, filed Oct. 13, 2017, Song, Limin et al.
U.S. Appl. No. 16/139,403, filed Oct. 13, 2017, Song, Limin et al.
U.S. Appl. No. 16/139,414, filed Oct. 13, 2017, Zhang, Yibing et al.
U.S. Appl. No. 16/139,421, filed Oct. 13, 2017, Song, Limin et al.
U.S. Appl. No. 16/139,427, filed Oct. 13, 2017, Disko, Mark M. et al.
U.S. Appl. No. 16/175,418, filed Oct. 30, 2018, Kent, David K. et al.
U.S. Appl. No. 62/588,067, filed Nov. 17, 2017, Song, Limin et al.
U.S. Appl. No. 62/588,080, filed Nov. 17, 2017, Kinn, Timothy F. et al.
U.S. Appl. No. 62/588,103, filed Nov. 17, 2017, Yi, Xiaohua et al.
Arroyo, Javier et al. (2009) "Forecasting Histogram Time Series with K-Nearest Neighbours Methods," *International Journal of Forecasting*, v.25, pp. 192-207.
Arroyo, Javier et al. (2011) "Smoothing Methods for Histogram-Valued Time Seriers: An Application to Value-at-Risk," *Univ. of California, Dept. of Economics*, www.wileyonlinelibrary.com, Mar. 8, 2011, 28 pages.
Arroyo, Javier et al. (2011) "Forecasting with Interval and Histogram Data Some Financial Applications," *Univ. of California, Dept. of Economics*, 46 pages.
Gonzalez-Rivera, Gloria et al. (2012) "Time Series Modeling of Histogram-Valued Data: The Daily Histogram Time Series of S&P500 Intradaily Returns," *International Journal of Forecasting*, v.28, 36 pgs.
Gutierrez-Estevez, M. A. et al. (2013) "Acoustic Boardband Communications Over Deep Drill Strings using Adaptive OFDM", *IEEE Wireless Comm. & Networking Conf.*, pp. 4089-4094.
Qu, X. et al. (2011) "Reconstruction fo Self-Sparse 20 NMR Spectra From undersampled Data in the Indirect Dimension", pp. 8888-8909.
U.S. Department of Defense (1999) "Interoperability and Performance Standards for Medium and High Frequency Radio Systems," *MIL-STD-188-141B*, Mar. 1, 1999, 584 pages.

* cited by examiner

REAL-TIME WELL SURVEILLANCE USING A WIRELESS NETWORK AND AN IN-WELLBORE TOOL

CROSS REFERENCE TO RELATED APPLICATIONS

This application claims the benefit of U.S. Provisional Application No. 62/107,900 filed on Jan. 26, 2015. This application is related to PCT Patent Application No. PCT/US13/76281 filed Dec. 18, 2013, entitled "Wired and Wireless Downhole Telemetry Using Production Tubing," and is incorporated by reference herein in its entirety.

BACKGROUND OF THE INVENTION his section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present invention relates to the field of data transmission along a tubular body. More specifically, the invention relates to the acoustic transmission of data along pipes within a wellbore. The present invention further relates to a hybrid wired-and-wireless transmission system for transmitting data along a downhole tubular string and to an in-wellbore tool incident to completion operations.

General Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with cement. The combination of cement and casing strengthens the wellbore and facilitates the isolation of formations behind the casing.

It is common to place several strings of casing having progressively smaller outer diameters into the wellbore. A first string may be referred to as surface casing. The surface casing serves to isolate and protect the shallower, fresh water-bearing aquifers from contamination by drilling fluids. Accordingly, this casing string is almost always cemented entirely back to the surface. A next smaller string of casing is then run into the wellbore.

A process of drilling and then cementing progressively smaller strings of casing is repeated several times below the surface casing until the well has reached total depth. In some instances, the final string of casing is a liner, that is, a string of casing that is not tied back to the surface. The final string of casing, referred to as a production casing, is also typically cemented into place.

In some completions, the production casing (or liner) has swell packers spaced across production intervals. This creates annular compartments for isolation of the zones during stimulation treatments and production. In this instance, the annulus may simply be packed with sand.

As part of the completion process, the production casing is perforated at a desired level. This means that lateral holes are shot through the casing and the cement column surrounding the casing. The perforations allow reservoir fluids to flow into the wellbore. In the case of swell packers or individual compartments, the perforating gun penetrates the casing, allowing reservoir fluids to flow from the rock formation into the wellbore along a corresponding zone.

After perforating, the formation is typically fractured in the various zones. Fracturing consists of injecting an aqueous fluid into a formation at such high pressures and rates that the reservoir rock parts and forms a network of fractures. The fracturing fluid is typically mixed with a proppant material such as sand, crushed granite, ceramic beads or other granular materials. The proppant serves to hold the fracture(s) open after the hydraulic pressures are released.

In order to further stimulate the formation and to clean the near-wellbore regions downhole, an operator may choose to "acidize" the formations. This is done by injecting an acid solution down the wellbore and through the perforations. The use of an acidizing solution is particularly beneficial when the formation comprises carbonate rock. In operation, the completion company injects a concentrated formic acid or other acidic composition into the wellbore, and directs the fluid into selected zones of interest. The acid helps to dissolve carbonate material, thereby opening up porous channels through which hydrocarbon fluids may flow into the wellbore. In addition, the acid helps to dissolve drilling mud that may have invaded the formation and that remains along the wellbore.

In some instances, the wellbore is left uneased along the pay zones. This means that no liner string is used. This is known as an open hole completion. To support the open wellbore and to prevent the migration of sand and fines into the wellbore, a filtering screen is typically placed along the subsurface reservoirs. A column of sand may also be installed around the filtering screen, thereby forming a gravel pack. In this instance, the wellbore is not perforated and fractured, although it may still be acid-treated.

The application of hydraulic fracturing and/or acid stimulation as described above is a routine part of petroleum industry operations as applied to individual hydrocarbon-producing formations (or "pay zones"). Such pay zones may represent up to about 60 meters (100 feet) of gross, vertical thickness of subterranean formation. More recently, wells are being completed through a producing formation horizontally, with the horizontal portion extending possibly 5,000, 10,000 or even 15,000 feet.

When there are multiple or layered formations to be hydraulically fractured, or a very thick hydrocarbon-bearing formation (over about 40 meters, or 131 feet), or where an extended-reach horizontal well is being completed, then more complex treatment techniques are required to obtain treatment of the entire target formation. In this respect, the operating company must isolate various zones or sections to ensure that each separate zone is not only perforated, but adequately fractured and treated. In this way the operator is sure that fracturing fluid and proppant are being injected through each set of perforations and into each zone of interest to effectively increase the flow capacity at each desired depth.

The isolation of various zones for pre-production treatment requires that the intervals be treated in stages. It is desirable to obtain data from the wellbore during the completion operation. In the oil and gas industry, communication systems have been introduced for monitoring downhole conditions and wellbore orientation during drilling. Such systems include mud pressure pulse transmission, or so-called mud pulse telemetry, which uses the drilling and wellbore fluids as a data transmission medium. Such also includes acoustic telemetry which uses the drill pipe as a transmission medium. Such also includes radiofrequency signals wherein electrodes placed in the pin and box ends of pipe joints are tuned to receive RF signals, which are transmitted along the pipe joints.

It is also known to use fiber optic cables and electrical wires in a wellbore for communicating data. Cables and wires transmit data front a downhole sensor or measurement device during production. However, cables and wires generally are not used in connection with perforating, fracturing and acid-treating operations.

Still further, it is known to run logging tools and downhole sensors into a wellbore at the end of a wireline during production or remediation operations. Such operations are generally referred to as well logging. However, logging operations cannot be conducted during perforating, fracturing and acid-treating operations.

Therefore, a need exists for a downhole telemetry network that enables sensors to wirelessly transmit data from various zones along a wellbore in real time, and then transmit that data wirelessly to a tool in the wellbore during completion operations. Further, a need exists for a method of receiving data during a wellbore completion operation from a telemetry network that combines wireless and wired data transmission in real time.

SUMMARY OF THE INVENTION

A method of transmitting data along a wellbore and up to a surface is first provided herein. The method uses a plurality of data transmission nodes situated along a tubular body to accomplish a rapid transmission of data up the wellbore and to the surface. The wellbore penetrates into a subsurface formation, allowing for the communication of a wellbore condition at the level of the subsurface formation up to the surface. Preferably, the wellbore includes an extended horizontal portion, with each of the data transmission nodes residing along the horizontal portion.

The method first includes placing two or more downhole sensors along the wellbore. The sensors are placed proximate a depth of the subsurface formation. In one aspect, the sensors reside within the housing of a respective sensor communications node. Alternatively, each of the two or more downhole sensors resides adjacent the housing of a corresponding sensor communications node, and is in electrical communication with a corresponding electro-acoustic transducer of the communications node. Preferably, each sensor communications node is secured externally to a joint of production casing, to a base pipe of a sand screen, or to a sliding sleeve device, by means of a clamp.

The sensors may include, for example, any of (i) pressure sensors, (ii) temperature sensors, (iii) induction logs, (iv) gamma ray logs, (v) formation density sensors, (vi) sonic velocity sensors, (vii) vibration sensors, (viii) resistivity sensors, (ix) flow meters, (x) microphones, (xi) geophones, (xii) strain gauges, or (xiii) combinations thereof.

Each sensor communications nodes has a transceiver for transmitting data. The data corresponds to the generated signals from the sensors, as data signals.

The method further includes running a downhole tool into the wellbore. The tool is run into the wellbore using a working string. The working string may be a coiled tubing string, a jointed working string, a slick line or an electric line.

The downhole tool includes an associated signal receiver. The signal receiver configured to receive the data signals from the various sensor communications nodes as the downhole tool passes the nodes.

In one aspect, the sensor communications nodes transmit acoustic signals to intermediate communications nodes, which then transmit signals node-to-node up to a receiver communications node. The signal receiver is then configured to receive the data signals from the receiver communications node. In another embodiment, the sensor communications nodes transmit data signals themselves to the signal receiver. This is done by means of a wireless transmission. The wireless transmission may be, for example, by means of a radio signal, an optic signal, Wi-Fi, Bluetooth, or an inductive electro-magnetic signal.

The method also includes receiving data from the signal receiver at the surface. The data is indicative of one or more sensed subsurface conditions. For a land-based operation, the surface is an earth surface, preferably at or near the well head. For an offshore operation, the surface may be a production platform, a drilling rig, a floating ship-shaped vessel, or an FPSO.

In one embodiment, the working string is an electric line, while the downhole tool is a perforating gun that is run into the wellbore on the electric line. In this instance, transmitting data signals from the sensor communications nodes to the signal receiver comprises transmitting data signals in connection with a zone being perforated. In addition, receiving data from the signal receiver at the surface comprises receiving data through the electric line in real time.

In another embodiment, the working string is a coiled tubing, while the downhole tool is a nozzle at an end of the coiled tubing. In this instance, transmitting data signals from the sensor communications nodes to the signal receiver comprises transmitting data signals in connection with a zone receiving a fracturing fluid or an injection of acid. In addition, receiving data from the signal receiver at the surface comprises spooling the coiled tubing to the surface, retrieving the signal receiver, and uploading data from the signal receiver to a micro-processor.

In still another embodiment, the downhole tool is a logging tool that is run into the wellbore on a line. In this instance, transmitting data signals from the sensor communications nodes to the signal receiver comprises transmitting data signals in connection with a well logging operation. The working string may be an electric line, in which case receiving data from the signal receiver at the surface comprises receiving data through the electric line in real time. Alternatively, the working string may be a slick line or a coiled tubing string, in which case receiving data from the signal receiver at the surface comprises spooling the working string to the surface, retrieving the signal receiver, and uploading data from signal receiver to a micro-processor.

A downhole telemetry system is also provided herein. The system employs novel communications nodes spaced along pipe joints within a wellbore. The pipe joints may be, for example, joints of casing (including a liner), base pipes of joints of sand screen, sliding sleeve devices, or combinations thereof.

The system first comprises two or more downhole sensors. Each of the sensors resides along the wellbore within a subsurface formation. The subsurface formation preferably includes hydrocarbon fluids in commercially viable quantities. Each of the downhole sensors is configured to sense a subsurface condition, and then send a signal indicative of that subsurface condition.

In one aspect, the subsurface condition is pressure. In that instance, the sensor is a pressure sensor. In another aspect, the subsurface condition is temperature, in which case the sensor is a temperature sensor. Other types of sensors may be used. These include induction logs, gamma ray logs, formation density sensors, sonic velocity sensors, vibration sensors, resistivity sensors, flow meters, microphones, geophones, strain gauges, or combinations thereof.

In the present system, the wellbore may be divided into production zones. A downhole sensor is placed along the wellbore within each production zone.

The system also includes two or more sensor communications nodes. The sensor communications nodes also reside along the wellbore and within the subsurface formation. Each of the sensor communications nodes has a housing. The housing is fabricated from a steel material. In one aspect, each of the communications nodes also has a sealed bore formed within the housing. The bore holds electronic components, including an electro-acoustic transducer and associated transceiver. The transceiver is designed to generate an acoustic signal along the pipe.

Each sensor communications node is independently powered. Thus, an independent power source such as a battery or a fuel cell is provided within the bore of each housing for providing power to the transceiver.

Each of the two or more downhole sensors resides within the housing of a corresponding sensor communications node. Alternatively, each of the two or more downhole sensors resides adjacent the housing of a corresponding sensor communications node, and is in electrical communication with the corresponding electro-acoustic transducer, such as by means of an insulated wire.

The downhole acoustic telemetry system also comprises a series of intermediate communications nodes. The intermediate communications nodes are placed between the two or more sensor communications nodes.

Each intermediate communications node has a housing that is fabricated from a steel material. In one aspect, each of the communications nodes also has a sealed bore formed within the housing. The bore holds electronic components, including an electro-acoustic transducer and associated transceiver. The transceiver is designed to generate an acoustic signal along a pipe so that acoustic signals may be sent from node-to-node, using the subsurface pipe as a carrier medium. Preferably, the intermediate communications nodes are spaced at one node per joint of pipe. Alternatively, the intermediate communications nodes may be placed along 2, 10, or even 20 joints of casing, with one node per joint.

The series of intermediate communications nodes includes a receiver communications node. The receiver communications node has a transceiver for wirelessly transmitting data corresponding to the electro-acoustic waves to a downhole signal receiver, as data signals.

The acoustic signals represent the data generated by the sensor. In this way, data about subsurface conditions are transmitted from node-to-node up to the receiver communications node. In one aspect, the communications nodes transmit data as mechanical waves at a rate exceeding about 50 bps.

BRIEF DESCRIPTION OF THE DRAWINGS

So that the present inventions can be better understood, certain drawings, charts, graphs anchor flow charts are appended hereto. It is to be noted, however, that the drawings illustrate only selected embodiments of the inventions and are therefore not to be considered limiting of scope, for the inventions may admit to other equally effective embodiments and applications.

In FIG. 5A, the leading edge, or front, of the shoe is seen. In FIG. 5B, the back of the shoe is seen.

DETAILED DESCRIPTION OF CERTAIN EMBODIMENTS

Definitions

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (15° C. to 20° C. and 1 atm pressure). Hydrocarbon fluids may include, for example, oil, natural gas, gas condensates, coal bed methane, shale oil, shale gas, and other hydrocarbons that are in a gaseous or liquid state.

As used herein, the term "subsurface" refers to geologic strata occurring below the earth's surface.

As used herein, the term "sensor" includes any electrical sensing device or gauge. The sensor may be capable of monitoring or detecting pressure, temperature, fluid flow, vibration, resistivity, sounds, or other formation data.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refer to a portion of a subsurface formation containing hydrocarbons. The term "hydrocarbon-bearing formation" may alternatively be used.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular member," "tubular body" or "subsurface pipe" refer to any pipe, such as a joint of casing, a portion of a liner, a production tubing, an injection tubing, a pup joint, underwater piping, an ICD joint, a sliding sleeve device, or a base pipe in a sand screen.

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Figure 1:
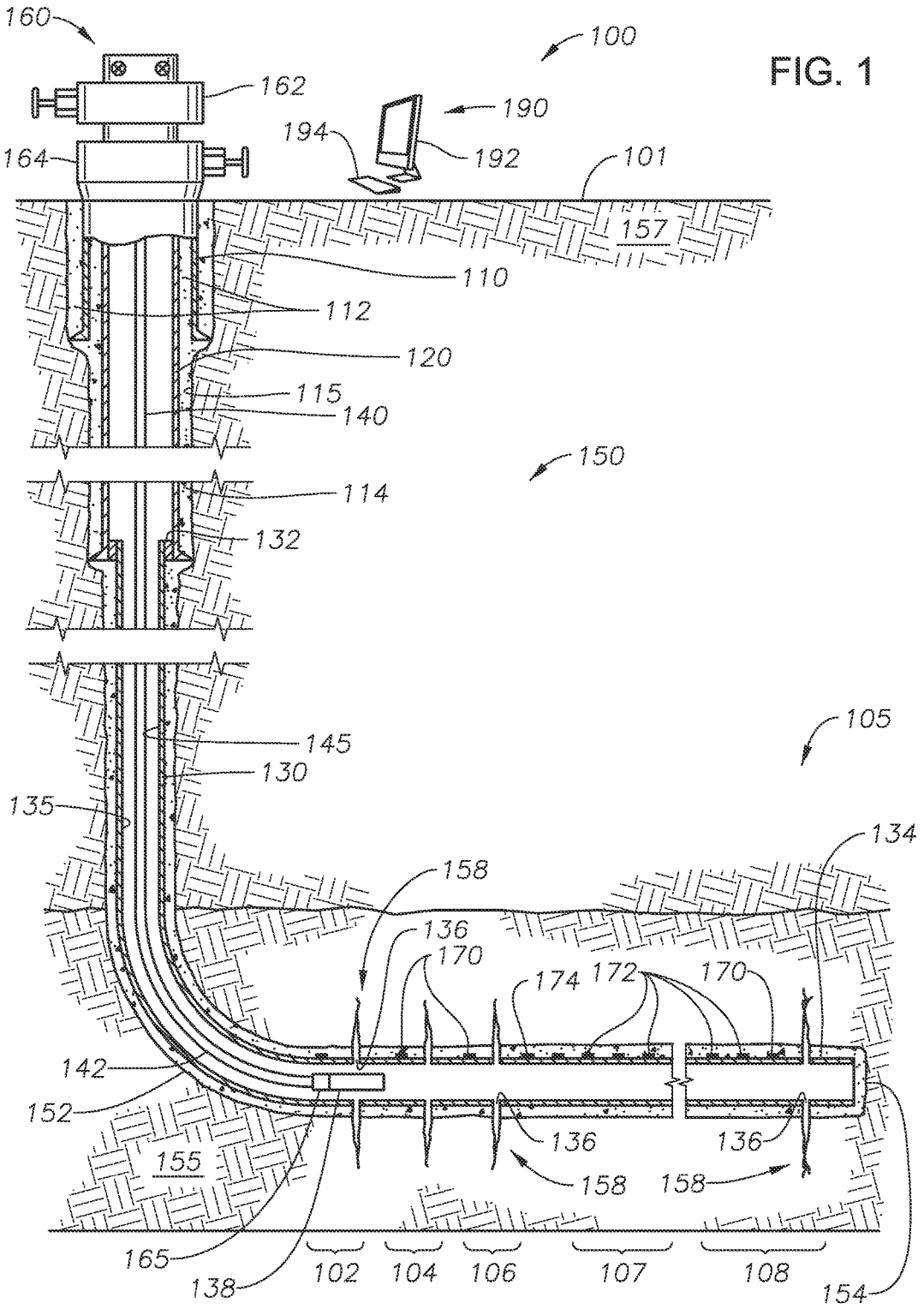
FIG. 1 is a side, cross-sectional view of an illustrative wellbore. The wellbore has been completed as a cased hole completion. A series of communications nodes is placed along a horizontal portion of the wellbore. The communications nodes transmit signals to a signal receiver associated with an in-wellbore tool.

FIG. 1 is a side, cross-sectional view of an illustrative well site 100. The well site 100 includes a wellbore 150 that penetrates into a rock matrix 155 below a surface 101. The surface 101 may be an earth surface; alternatively, the surface 101 may be an offshore drilling rig or platform over a body of water. The wellbore 150 has been completed as a cased-hole completion for producing hydrocarbon fluids from a subsurface formation 155.

The well site 100 includes a well head 160. The well head 160 is positioned at the surface 101 over the wellbore 150. The well head 160 controls the flow of formation fluids from the subsurface formation 155 to the surface 101 upon completion. The well head 160 also facilitates the run-in of tools during completion of the wellbore 150, and the injection of treatment fluids such as acid.

The well head 160 may be any arrangement of pipes or valves that receives reservoir fluids at the top of the wellbore 150. In the arrangement of FIG. 1, the well head 160 includes a top valve 162 and a bottom valve 164. In some contexts, these valves are referred to as "master valves."

The wellbore 150 has been completed with a series of pipe strings, referred to as casing. First, a string of surface casing 110 has been cemented into a rock matrix 157. Cement 112 is shown in an annular space 115 within the wellbore 150 surrounding the casing 110. The surface casing 110 has an upper end in sealed connection with the lower valve 164.

Next, at least one intermediate string of casing 120 is cemented into the wellbore 150. The intermediate string of casing 120 is in sealed fluid communication with the upper master valve 162. Cement 114 is again shown in an annular space 115 of the wellbore 150 within the rock matrix 157. The combination of the casing strings 110, 120 and the cement sheath 112 in the annulus 115 strengthens the wellbore 150 and facilitates the isolation of formations behind the casing 110, 120.

It is understood that a wellbore 150 may, and typically will, include more than one string of intermediate casing. Some of the intermediate casing strings may be only partially cemented into place, depending on regulatory requirements and the presence of migratory fluids in any adjacent strata. In some instances, an intermediate string of casing may be a liner.

Finally, a production string 130 is provided. The illustrative production string 130 is hung from the intermediate casing string 120 using a liner hanger 132. The production string 130 is a liner that is not tied back to the surface 101. A portion of the production liner 130 may optionally be cemented in place.

The production liner 130 has a "lower" end 134 that extends substantially to an end (or toe) 154 of the wellbore 150. For this reason, the wellbore 150 is said to be completed as a cased-hole well. In an alternate aspect, the production string 130 is not a liner but is a casing string that extends back to the surface 101. If the liner is not cemented in place, it is an open-hole well.

The illustrative wellbore 150 is completed as a horizontal wellbore. The wellbore 150 includes an horizontal portion 105. The horizontal portion 105 is defined by a heel and the toe 154. The horizontal portion 105 penetrates into and extends along the subsurface formation 155.

The liner 130 contains a bore 135. Upon completion, the bore 135 will receive production fluids and, preferably, a packer and a string of production tubing (not shown). In order to create fluid communication between the bore 135 of the liner 130 and the surrounding rock matrix 157 making up the subsurface formation 155, the liner 130 is being perforated. Perforations are seen along the production casing 130 at 136.

To create the perforations 136, a perforating gun 138 is deployed into the bore 135. The perforating gun 138 is pumped into the horizontal portion 105 at the end of a working string 140. The working string 140 is unspooled from the surface 101 so that a lower end 142 of the working string 140 ultimately extends towards the end 134 of the liner 130.

After perforating the liner 130, the subsurface formation 155 is fractured. Hydraulic fracturing consists of injecting an aqueous fluid with friction reducers or viscous fluids (usually shear thinning, non-Newtonian gels or emulsions) into the formation 155 at such high pressures and rates that the reservoir rock parts and forms a network of fractures 158. As noted above, the fracturing fluid is typically mixed with a proppant material such as sand or ceramic beads. The proppant serves to hold the fractures 158 open after the hydraulic pressures are released. In the case of so-called "tight" or unconventional formations, the combination of fractures and injected proppant substantially increases the flow capacity of the treated reservoir.

Preferably, the horizontal portion 105 of the wellbore 150 is a so-called extended-reach wellbore. This means that the horizontal portion 105 extends over 1,000 feet, and possibly as much as 15,000 feet. For extended reach wellbores, it is common to complete the wellbore by perforating and fracturing in sequential zones. This is typically done from toe-to-heel.

In the view of FIG. 1, perforations 136 and fractures 158 are provided in four separate zones 102, 104, 106, 108. Each zone may represent, for example, a length of up to about 100 feet (30 meters). While only four sets of perforations 136 and fractures 158 are shown, it is understood that the horizontal portion 105 may have many more sets of perforations 136 and fractures 158 in additional zones.

Where the natural or hydraulically-induced fracture planes of a formation are vertical, a horizontally completed wellbore (portion 105) allows the production casing 130 to intersect multiple fracture planes. Horizontal completions are common for wells that are completed in so-called "tight" or "unconventional" formations. However, the present inventions have equal utility in vertically completed wells or in multi-lateral deviated wells.

It is desirable to monitor subsurface conditions during the completions process. To accomplish this, a series of novel communications nodes is provided. The communications nodes are referred to as sensor communications nodes, and are indicated at 170. The nodes 170 are shown spaced along an outer diameter of the production casing 130.

Figure 3:
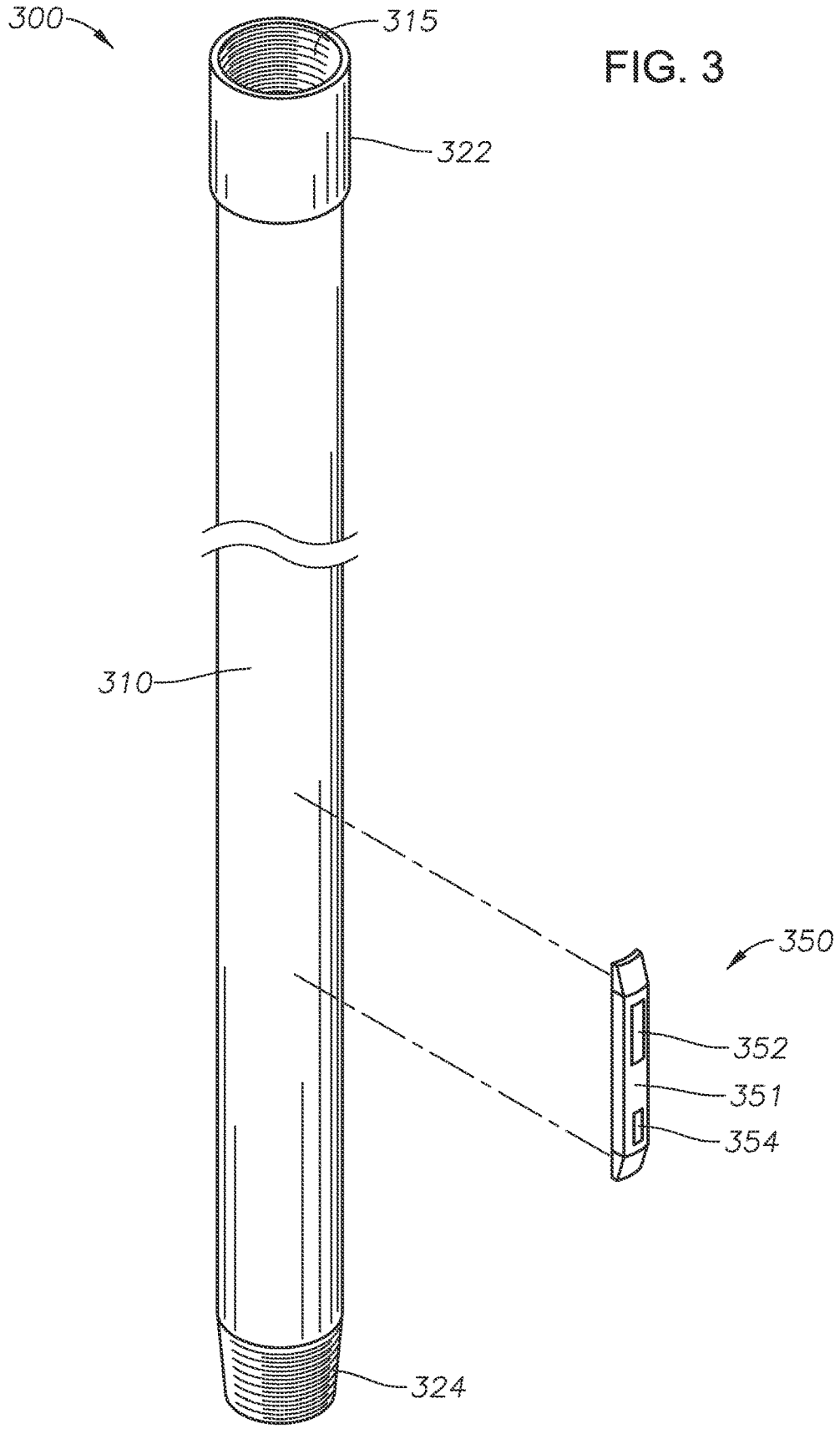
FIG. 3 is a perspective view of an illustrative pipe joint. An electro-acoustical communication node is shown exploded away from the pipe joint.

FIG. 3 offers an enlarged perspective view of a communication node 350 and an associated pipe joint 300. The illustrative communications node 350 is shown exploded away from the pipe joint 300 for clarity.

The pipe joint 300 is intended to represent a joint of production casing. The pipe joint 300 has an elongated wall 310 defining an internal bore 315. The bore 315 transmits hydrocarbon fluids during an oil and gas production operation. The pipe joint 300 has a box end 322 having internal threads, and a pin end 324 having external threads. The communications node 350 resides intermediate the box end 322 and the pin end 324.

The communications node 350 shown in FIG. 3 is designed to be pre-welded onto the wall 310 of the pipe joint 300. Alternatively, the communications node 350 may be glued to the wall 310 using an adhesive such as epoxy. However, it is preferred that the communications node 350 be configured to be selectively attachable to/detachable from a pipe joint 300 by mechanical means at the well site 100. This may be done, for example, through the use of clamps. Such a clamping system is shown at 600 in FIG. 6, described more fully below. In any instance, the communications node 350 offers an independently-powered, electro-acoustical communications device that is designed to be attached to an external surface of a well pipe 300.

There are benefits to the use of an externally-placed communications node that uses acoustic waves. For example, such a node will not interfere with the flow of fluids within the internal bore 315 of the pipe joint 300. Further, installation and mechanical attachment can be readily assessed or adjusted, as necessary, using clamps. Because the acoustic signals are carried by the wall 310 of the pipe joint 300 itself, the data is largely unaffected by the fluids in the pipe joint 300.

In FIG. 3, the communications node 350 includes an elongated body 351. The body 351 supports one or more batteries, shown schematically at 352. The body 351 also supports a transmitter, shown schematically at 354. As described in more detail below, in one embodiment the transmitter 354 is designed to send wireless acoustic signals to a signal receiver 165 that resides in the wellbore 150. In another embodiment, the transmitter 354 sends wireless signals to a receiver.

In operation, each sensor communications node 170 is in electrical communication with a downhole sensor. This may be by means of a short wire, or by means of wireless communication such as infrared or radio-frequency communication. The sensor communications nodes 170 are configured to receive signals from the sensors, wherein the signals represent a subsurface condition. The subsurface condition may be pressure detected by a pressure sensor. A pressure sensor may be, for example, a sapphire gauge or a quartz gauge. Sapphire gauges are preferred as they are considered more rugged for the high-temperature downhole environment. Alternatively, the sensors may be temperature sensors. Alternatively, the sensors may be microphones for detecting ambient noise, or geophones (such as a tri-axial geophone) for detecting the presence of micro-seismic activity.

In the telemetry network of FIG. 1, each sensor communications node 170 will be in electrical communication with a downhole sensor (shown at 432 in the FIG. 4 series of drawings). As noted, the sensor 432 may be a pressure sensor or a temperature sensor. Alternatively, a sensor may be a fluid flow measurement device such as a spinner, a sonic velocity sensor or other flow meter. Alternatively, a sensor may be a vibration sensor, a fluid composition sensor, a microphone, or a geophone. Alternatively still, a sensor may be a formation sensor such as an induction log, a gamma ray log, a formation density sensor, or a resistivity sensor. A sensor may alternatively be a strain gauge that detects the condition or integrity of the pipe wall.

All of these conditions encompass the term "subsurface condition" as used herein.

Referring again to FIG. 1, it is observed that only one sensor communications node 170 resides in each production zone (zones 102, 104, 106 and 108). The sensor communications nodes 170 are configured to process signals generated by the downhole sensors and transmit those signals to a signal receiver 165 in the bore 135 as data signals.

To harvest the data signals, a downhole tool is run into the bore 135 at the end 142 of a working string 140. In the arrangement of FIG. 1, the downhole tool is a perforating gun 138 having multiple charges. The working string 140 is an electric line that delivers a signal from the surface to detonate select charges in the perforating gun 138 at the production zones 102, 104, 106 and 108.

The signal receiver 165 also resides at the end 142 of the working string 140. In operation, the perforating gun 138 is pumped to the toe 154 of the horizontal portion 155. The perforating gun 138 is then raised in the wellbore 150. As the perforating gun 138 arrives at a production zone to be perforated (such as Zone 108) a signal is sent from the operator at the surface 101 to detonate charges in the perforating gun 160. This causes the production liner 130 to be perforated (see perforations 136). Thereafter, the rock matrix 157 along the subsurface formation 155 will be fractured (see fractures 158).

It is preferred that the process of perforating and fracturing be conducted in as seamless (i.e., non-stop) a manner as possible. One technique for this process is the Just-In-Time Perforating (or "JITP") process. The JITP process, and other techniques, are discussed in U.S. Patent Publ. No. 2013/0062055, which is entitled "Assembly And Method For Multi-Zone Fracture Stimulation of A Reservoir Using Autonomous Tubular Units."

Figure 4A:
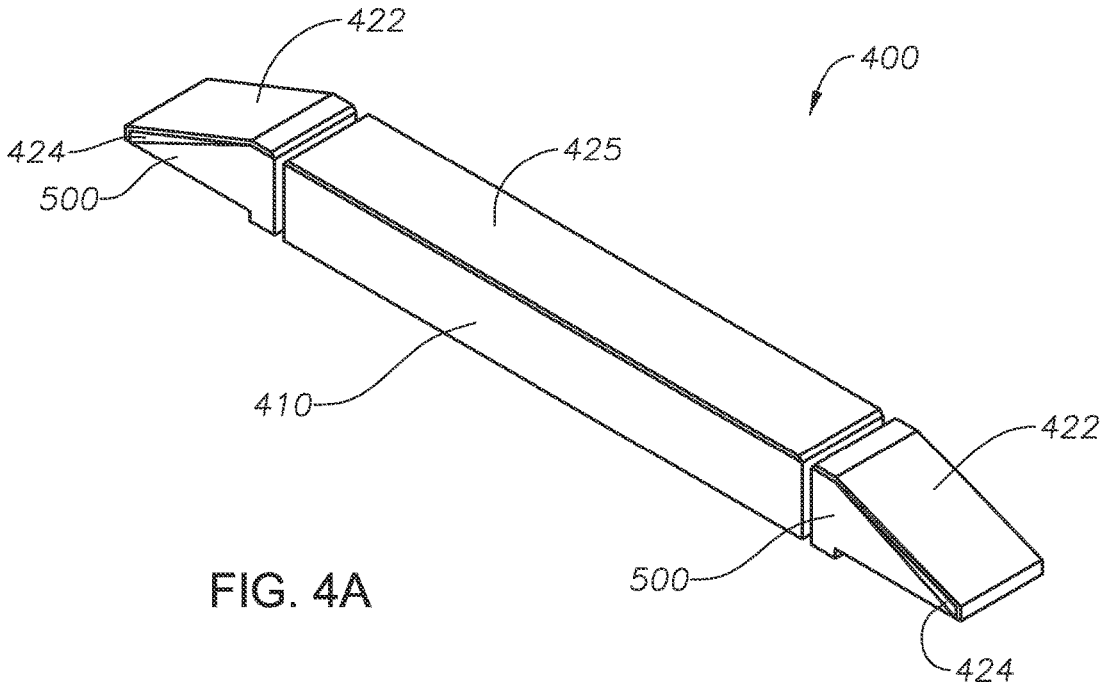
FIG. 4A is a perspective view of a communications node as may be used in the electro-acoustical data transmission systems of the present invention, in one embodiment.
Figure 4B:
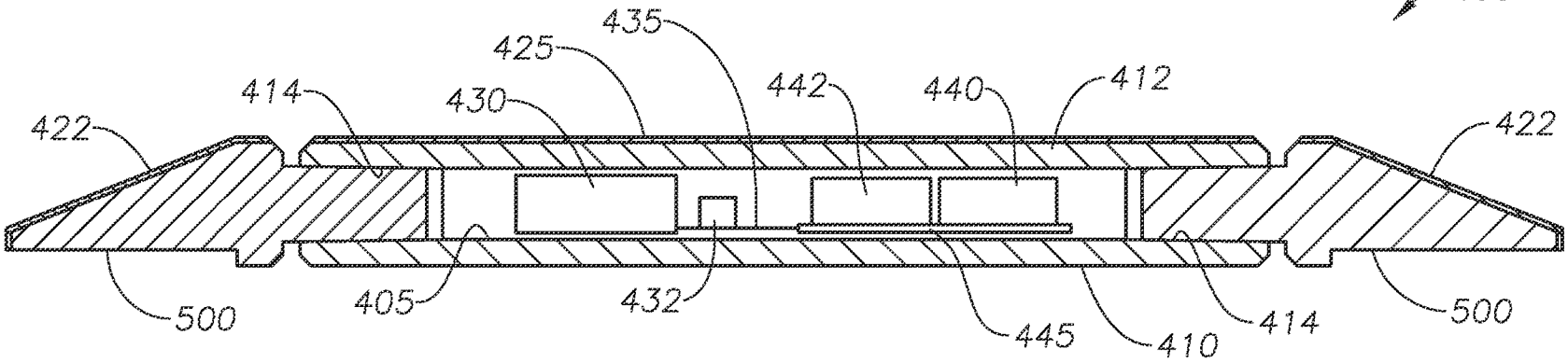
FIG. 4B is a cross-sectional view of the communications node of FIG. 4A. The view is taken along the longitudinal axis of the node. Here, a sensor is provided within the communications node.
Figure 4C:
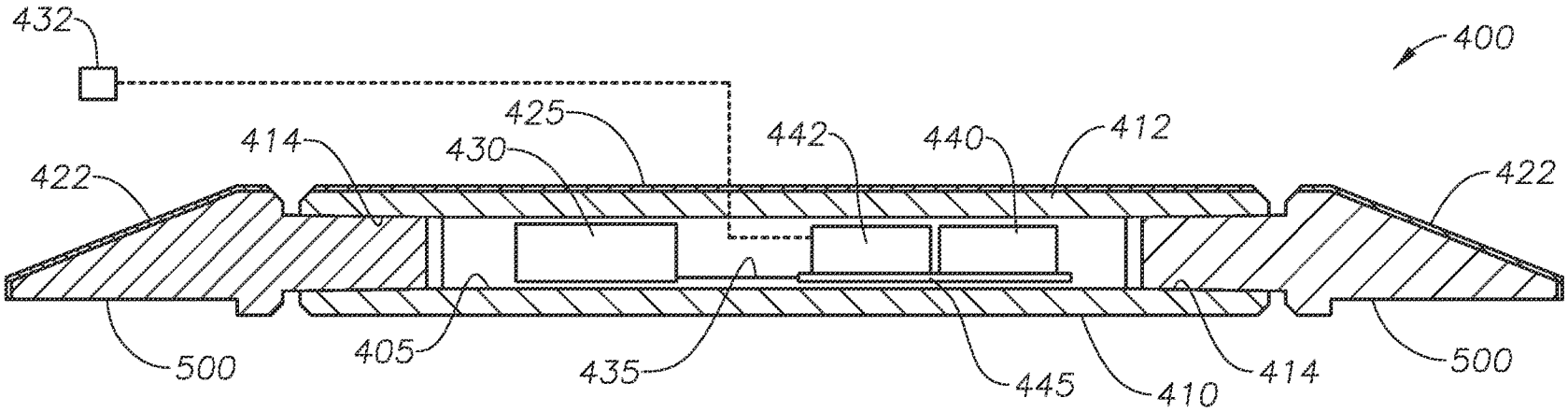
FIG. 4C is another cross-sectional view of the communications node of FIG. 4A, in an alternate embodiment. The view is again taken along the longitudinal axis of the node, Here, a sensor resides along the wellbore external to the communications node.

Regardless of the process, the sensor communications nodes 170 will transmit data signals from a receiver residing within a housing (shown at 410 in the FIG. 4 series of drawings). As the signal receiver 165 crosses a sensor communications node 170, it will pick up the data signals through a wireless transmission. The wireless transmission may be Bluetooth, Wi-Fi, optic signals, radio frequency signals, ZigBee, or other protocol. The data signals are then sent up the bore 135 to the surface 101 by means of the electric line 140. In this way, conditions sensed by the downhole sensors (not shown in FIG. 1, but indicated at 432 in FIGS. 4B and 4C) are delivered to the operator at the surface 101 in real time.

It is observed in FIG. 1 that the horizontal portion 155 of the wellbore 150 includes an extended non-production Zone 107. The liner 130 along this Zone 107 includes a plurality of intermediate communications nodes 172. In one option, the sensor communications node 170 along Zone 108 sends signals indicative of sensed downhole conditions to a first intermediate communications nodes 172, such as through the use of an electrical wire. That signal is then sent along the liner 130 via acoustic signals using the pipe as a carrier medium.

FIG. 4A is a perspective view of a communications node 400 as may be used in the wellbore 150 of FIG. 1A, in a more detailed embodiment. In one aspect, the communications node 400 is designed to provide acoustic communication using a transceiver within a novel downhole housing assembly. FIG. 4B is a cross-sectional view of the communications node 400 of FIG. 4A. The view is taken along the longitudinal axis of the node 400. The communications node 400 will be discussed with reference to FIGS. 4A and 4B, together.

The communications node 400 first includes a housing 410. The housing 410 is designed to be attached to an outer wall of a joint of wellbore pipe, such as the pipe joint 300 of FIG. 3. Where the wellbore pipe is a carbon steel pipe joint such as drill pipe, casing or liner, the housing 410 is preferably fabricated from carbon steel. This metallurgical match avoids galvanic corrosion at the coupling.

The housing 410 is dimensioned to be strong enough to protect internal electronics. In one aspect, the housing 410 has an outer wall 412 that is about 0.2 inches (0.51 cm) in thickness. A bore 405 is formed within the wall 412. The bore 405 houses the electronics, shown in FIG. 4B as a battery 430, a power supply wire 435, a transceiver 440, and a circuit board 445. The circuit board 445 will include a micro-processor or electronics module that processes acoustic signals, including the transceiver 440.

The first intermediate communications node 172 will receive an electrical signal from the sensor communications node 170. An electro-acoustic transducer 442 converts electrical energy to acoustical energy (or vice-versa). The transducer 442 is coupled with outer wall 412 on the side attached to the tubular body and is preferably part of the circuit board 445.

It is noted that in FIG. 4B, the sensor 432 resides within the housing 410 of the communications node 400. However, as noted, the sensor 432 may reside external to the communications node 400, such as above or below the node 400 along the wellbore 150. In FIG. 4C, a dashed line is provided showing an extended connection between an external sensor 432 and an electro-acoustic transducer 442.

The transducer 442 may itself serve as a sensor. This allows active acoustic response along a section of casing, thereby allowing the operator to evaluate, for example, cement integrity. In another aspect, a separate sensor 432 is provided in the housing 410 and is in electrical communication with the transducer 442.

A first intermediate communications node 172 receives an electrical (or other) signal from the sensor communications node 170 along Zone 108. The transducer 442 converts the signals to acoustic signals, and then transmits the signals through the pipe to a next intermediate communications node 172, using the transceiver 440. Such acoustic waves are preferably at a frequency of between about 50 kHz and 500 kHz. More preferably, the acoustic wave are transmitted at a frequency of between about 100 kHz and 125 kHz. Those acoustic signals may be digitized by the microprocessor.

In one preferred embodiment, the acoustic telemetry data transfer is accomplished using multiple frequency shift keying (MFSK). Any extraneous noise in the signal is moderated by using well-known conventional analog and/or digital signal processing methods. This noise removal and signal enhancement may involve conveying the acoustic signal through a signal conditioning circuit using, for example, a bandpass filter. Alternatively, an acoustic modern is used as the transducer 442, wherein the modem uses orthogonal frequency-division multiplexing (OFDM) as a modulation technique.

In one preferred embodiment, an electrical signal is delivered to an electromechanical transducer, such as through a driver circuit. In a preferred embodiment, the transducer is the same electro-acoustic transducer that originally received the MESK data. The signal generated by the electro-acoustic transducer then passes through the housing 410 to the tubular body, that is, the liner 130, and propagates along the tubular body to a next intermediate communication node 172. The re-transmitted signal represents the same sensor data originally transmitted by sensor communications node 170 in Zone 108. In one aspect, the acoustic signal is generated and received by a tnagnetostrictive transducer comprising a coil wrapped around a core as the transceiver. In another aspect, the acoustic signal is generated and received by a piezo-electric ceramic transducer. In either case, the filtered signal is delivered up to a receiver communications node 174.

Referring back to FIGS. 4A and 4B, the communications node 400 optionally has a protective outer layer 425. The protective outer layer 425 reside external to the wall 412 and provides an additional thin layer of protection for the electronics. The communications node 400 is also fluid-sealed within the housing 410 to protect the internal electronics. Additional protection for the internal electronics is available using an optional potting material.

The communications node 400 also optionally includes a shoe 500. More specifically, the node 400 includes a pair of shoes 500 disposed at opposing ends of the wall 412. Each of the shoes 500 provides a beveled face that helps prevent the node 400 from hanging up on an external tubular body or the surrounding earth formation, as the case may be, during run-in or pull-out. The shoes 500 may have a protective outer layer 422 and an optional cushioning material 424 (shown in FIG. 4A) under the outer layer 422.

Figure 5A:
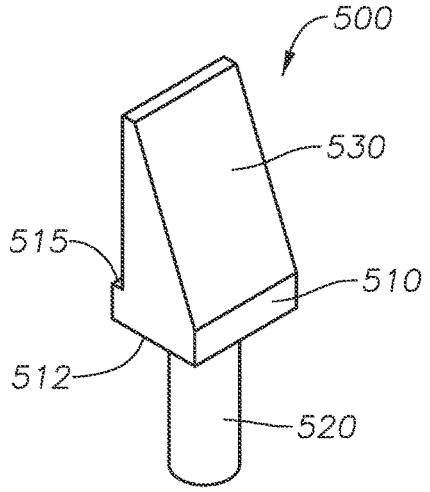
FIGS. 5A and 5B are perspective views of a shoe as may be used on opposing ends of the communications node of FIG. 4A, in one embodiment.
Figure 5B:
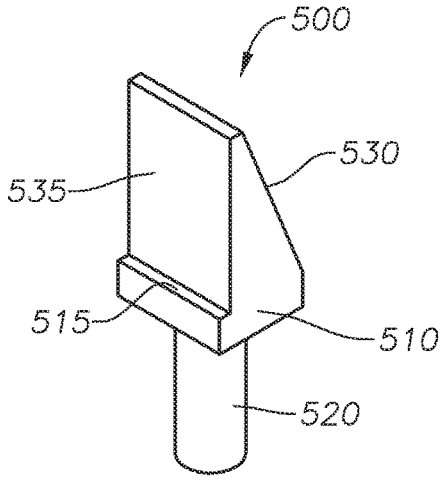

FIGS. 5A and 5B are perspective views of an illustrative shoe 500 as may be used on an end of the communications node 400 of FIG. 4A, in one embodiment. In FIG. 5A, the leading edge or front of the shoe 500 is seen, while in FIG. 4B the back of the shoe 500 is seen.

The shoe 500 first includes a body 510. The body 510 includes a flat under-surface 512 that butts up against opposing ends of the wall 412 of the communications node 400.

Extending from the under-surface 512 is a stem 520, The illustrative stem 520 is circular in profile. The stem 520 is dimensioned to be received within opposing recesses 414 of the wall 412 of the node 400.

Extending in an opposing direction from the body 510 is a beveled surface 530. As noted, the beveled surface 530 is designed to prevent the communications node 400 from hanging up on an object during run-in into a wellbore.

Behind the beveled surface 530 is a flat surface 535. The flat surface 535 is configured to extend along the liner string 130 when the communications node 400 is attached to the tubular body 130. In one aspect, the shoe 500 includes an optional shoulder 515. The shoulder 515 creates a clearance between the flat surface 535 and the tubular body opposite the stem 520.

Returning to FIG. 1, acoustic signals are sent, node-to-node, up the wellbore 150. Preferably, each joint of pipe along the liner string 130 contains one node 172. A last intermediate communications node, referred to as a receiver communications node 174, receives the acoustic signals. The signals are converted back to electrical (or other) signals, and are then transmitted to the receiver 165 as wireless data signals. In this way, the data signals are harvested from the receiver communications node 174 (along Zone 107) rather than the sensor communications node 170 (of Zone 108).

The downhole telemetry network of FIG. 1 enables a real-time surveillance of conditions during wellbore completion. Data is transmitted up the electrical working string 140 and received at a processor 190 residing at the surface 101. In one aspect, the processor 190 is a general purpose computer having a monitor 192 and a keyboard 194 as a user interface. The processor 190 is preferably at the wellsite 100, although it may be located remotely through a computer network. In one aspect, the processor 190 is part of a multi-purpose "smart phone" having specific applications, or "apps," and wireless connectivity.

Figure 2A:
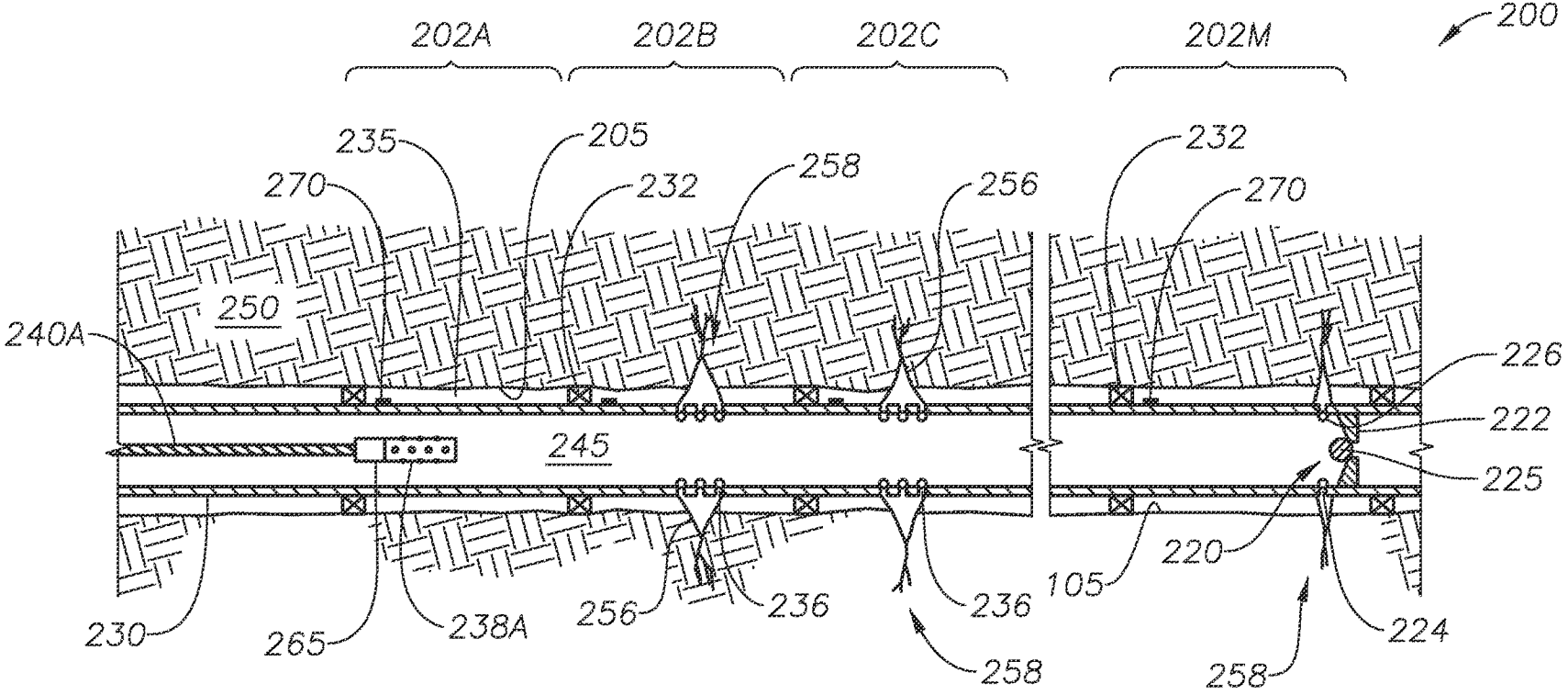
FIG. 2A is an enlarged cross-sectional view of a wellbore undergoing a staged perforation and fracturing operation. A lower, horizontal portion of the wellbore is shown. A series of communications nodes is placed along the production casing in the horizontal portion as part of a telemetry system.
Figure 2B:
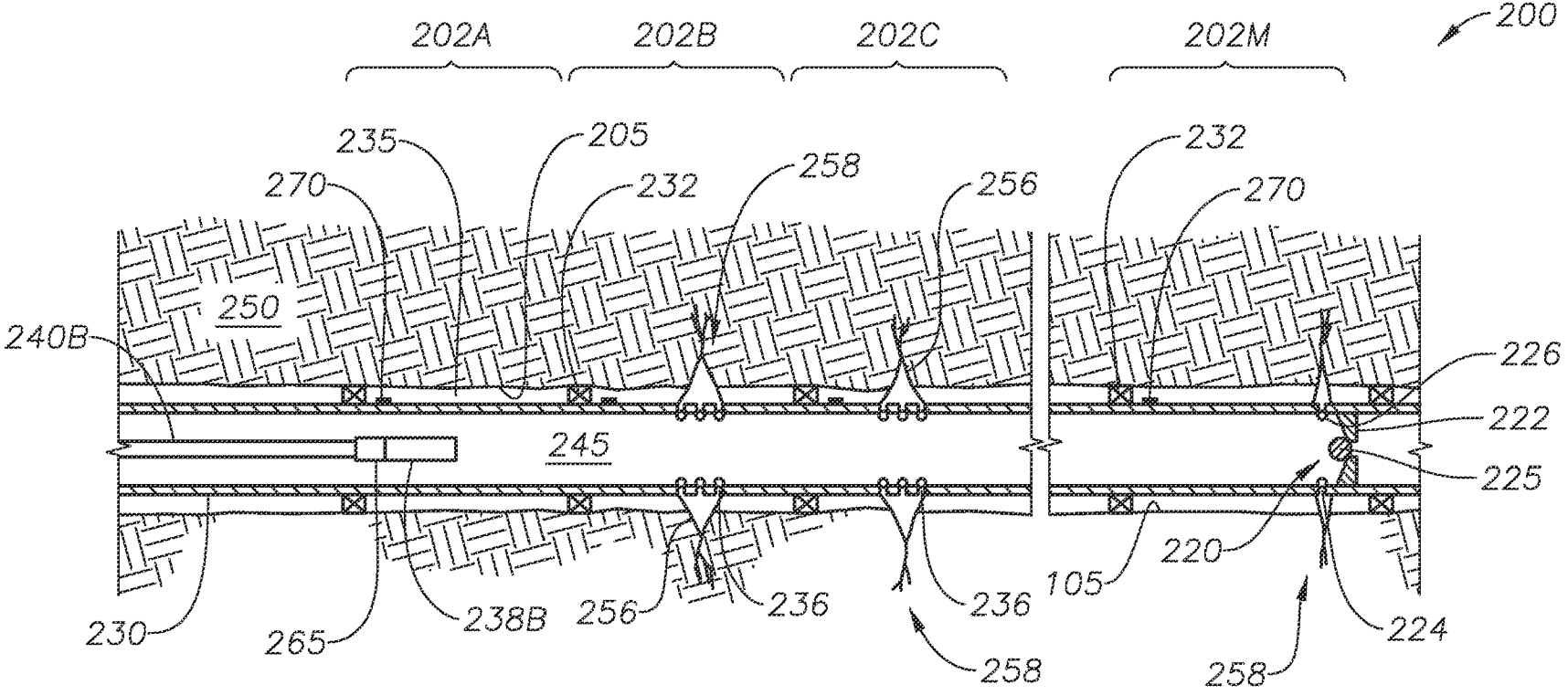
FIG. 2B is another enlarged cross-sectional view of a wellbore undergoing a staged acid injection operation. A lower, horizontal portion of the wellbore is shown. A series of communications nodes is placed along the production casing in the horizontal portion as part of a telemetry system.

Two specific applications to the downhole telemetry network are provided in FIGS. 2A and 2B. FIGS. 2A and 2B offer enlarged cross-sectional views of a wellbore 200. Here, only a lower, horizontal portion of the wellbore 200 is shown. The wellbore 200 is formed through a subsurface formation 250, wherein the subsurface formation 250 comprises a rock matrix holding hydrocarbon fluids in commercially viable quantities.

In the arrangement of FIGS. 2A and 2B, the wellbore 200 is again being completed as a cased hole wellbore. A string of production casing 230 is shown residing within a bore 205. An annular region 235 is formed between the casing 230 and the surrounding bore 205.

In each view, the wellbore 200 is divided into multiple zones, designated as 202A, 202B, 202C . . . 202M. Each zone 202A, 202B, 202C . . . 202M has a corresponding sensor communications node 270. The sensor communications nodes 270 are designed in accordance with node 400 of FIGS. 4A and 4B, except they do not utilize an acoustic transducer; instead, they utilize a transceiver for sending wireless signals. The sensor communications nodes 270 may include a housing such as housing 410.

To define the production zones 202A, 202B, 202C . . . 202M, packers 232 are placed in the annulus 205. The packers 232 may be, for example, swell packers or mechanically-set packers. An example of a suitable mechanically-set packer is described in U.S. Patent Publ. No. 2013/0248179 entitled "Packer For Alternate Flow Channel Gravel Packing and Method For Completing A Wellbore."

FIG. 2A shows that the wellbore 200 is undergoing a staged perforation and fracturing procedure. As a first step, a fracturing sleeve 220 residing along the liner 230 is activated. This is done by dropping a frac ball 225 onto a seat 222. Fluid is pumped into a bore 245 of the liner 230 until pressure is built up enough to cause the sleeve 200 to slide. Ports 224 are then exposed, allowing the formation 250 to be fractured along zone 202M.

It is understood that in order to pump the ball 225 down the bore 245 and to fracture the formation 250 along zone 202M, the bottom of the liner string 230 must be opened to the formation 250. This may be done by perforating the liner 230 below the sleeve 220 before the ball 225 is dropped.

During fracturing, the operator monitors pressure gauges at the surface 101. When pressure readings are sufficiently high to indicate that fractures 258 have been formed, the operator drops ball sealers 226 into the bore 245. The ball sealers 226 will eventually seat along the ports 224, sealing off zone 202M.

Thereafter, or simultaneously therewith, the operator raises the perforating gun 238A and shoots perforations into a new zone, such as a zone intermediate zones 202C and 202M. Pumping pressure is increased to form fractures in the formation 250 along the new zone. New ball sealers are then dropped into the bore 245, sealing off the newly formed perforations (not shown). This process is repeated until all zones are perforated and fractured, including zones 202C, 202B and 202A, from toe-to-heel.

It is understood that this process will require the perforating gun 238A to be periodically changed out as charges are detonated and exhausted. It is also understood that the process will likely involve the periodic placement of bridge plugs or the dropping of frac balls onto frac seats along the liner 130 to accomplish a staged perforating and fracturing operation. U.S. Patent Publ. No. 2013/0062055, entitled "Assembly And Method For Multi-Zone Fracture Stimulation of A Reservoir Using Autonomous Tubular Units," is again referenced for details of various processes.

In FIG. 2A, a perforating gun is show at 238A. An electric line is presented at 240A, supporting the perforating gun 238A and configured to deliver electrical signals to the perforating gun 238A. Perforations 236 and fractures 258 have been formed in Zones 202B-202M. Ball sealers 226 are shown along the perforations 236 in Zone 202B. The perforating gun 238A has now been raised to Zone 202A so that the formation 250 may be fracture-treated along Zone 202A.

It is observed that a signal receiver 265 is again disposed at the lower end of the working string 240A. The signal receiver 265 picks up wireless transmissions from the transmitter in the sensor communications nodes 270 as the receiver 265 crosses (or otherwise moves with a designated proximity to) the respective nodes 270 downhole. The designated proximity may be, for example, between 0.1 and 25 feet (0.9 and 7.6 meters). The receiver communications nodes 270 are affixed to an outer diameter of the horizontal production tubing 230.

In this application, the signal receiver 265 wirelessly receives signal data indicative of sounds, such as may be received by a microphone. Sounds may suggest the existence and extent of fractures, the presence of undesirable fluid flow behind casing, the presence of undesirable fluid flow through erstwhile-sealed perforations at a designated zone, and so forth. For example, if a bridge plug or a ball sealer leaks fluid during a hydraulic fracturing operation, the leak may be detected by analysis of downhole sound data.

In one aspect, rather than transmit raw sound data to the surface for analysis, the sensor communications nodes 170 may be programmed to perform a data analysis using their own on-board microprocessor, and then only transmit data signals if a downhole sensor has detected a leak. If a leak is detected, new ball sealers may be dropped.

The downhole tool of FIG. 2A is demonstrated as a perforating gun 238A at the end of an electric line. However, other downhole tools may also be represented. In one aspect, the downhole tool may be a logging tool or a lull bore drift tool.

FIG. 2B presents another application. Here, a new working line 240B and a new downhole tool are shown. In this view, the working line 240B is a string of coiled tubing that has been unspooled from the surface, while the downhole tool is a nozzle 238B for an acid injection procedure.

In the completion process for the wellbore 200 in FIG. 2B, it is desirable to inject an acid along the formation. The acid cleans out the perforations and the fracture channels. Acid may be injected into the bore 245 from the bottom of the wellbore, up. Beneficially, as the coiled tubing string 240B is pulled up the wellbore the signal receiver 265 will again cross the sensor communications nodes 270 and associated downhole sensors. Sensors may be used to listen for the flow of injected acid into the formation within the target zone.

After the acid injection operation, the coiled tubing string 240B is spooled back to the surface. The signal receiver 265 is retrieved and data from the sensor communications nodes 270 is uploaded to a processer 190. The operator may then analyze the data to determine Whether acid was appropriately injected into each desired zone.

It is understood that while FIG. 2B shows a wellbore 200 having been completed with production casing 230 as a cased hole completion, the wellbore 200 may alternatively be completed as an open-hole completion. In this instance, the wellbore will not have perforations 236, but instead will have a pre-perforated base pipe, with a surrounding sand screen. The base pipe is slotted to allow in ingress of filtered formation fluids into the wellbore 200. The sensor communications nodes 270 will then preferably be placed around the outer diameter of the steel base pipes. Acid injection is still desirable for such a completion to remove the so-called skin from the annulus 235.

It is also understood that a sand screen is actually a series of joints of screen, with each joint having a filter medium wrapped or wound around the base pipe. It is preferred, though not required, to place a gravel slurry (not shown) around the screen joints to support the surrounding formation 250 and to provide further fluid filtering. The use of sand screens with gravel packs allows for greater fluid communication with the surrounding rock matrix while still providing support for the wellbore 250.

Finally, it is understood that the working string 240B in FIG. 2B may be a jointed working string.

In any aspect, the present downhole telemetry network allows for a high speed transmission of data up to the surface 101 in a novel manner. Signals need not be sent acoustically, node-to-node, through all the strings of subsurface pipe. Further, the placement of separate communications nodes along every joint of pipe in the wellbore is not needed. Thus, the network is faster, more reliable and still less expensive than a full downhole acoustic telemetry system.

In each of FIGS. 1, 2A and 2B, the communications nodes 170, 270 are specially designed to withstand the same corrosion and environmental conditions (i.e., high temperature, high pressure) of a wellbore 150 or 250 as the casing strings or production tubing. To do so, it is preferred that the communications nodes 170, 270 include sealed steel housings for holding the electronics.

In one arrangement, the communications nodes (such as nodes 400 with the shoes 500) are welded onto an inner or outer surface of the tubular body, such as wall 310 of the pipe joint 300. More specifically, the body 410 of the respective communications nodes 400 are welded onto the wall of the tubular body. In some cases, it may not be feasible or desirable to pre-weld the communications nodes 400 onto pipe joints before delivery to a well site. Further still, welding may degrade the tubular integrity or damage electronics in the housing 410. Therefore, it is desirable to utilize a clamping system that allows a drilling or service company to mechanically connect/disconnect the communications nodes 400 along a tubular body as the tubular body is being run into a wellbore.

Figure 6:
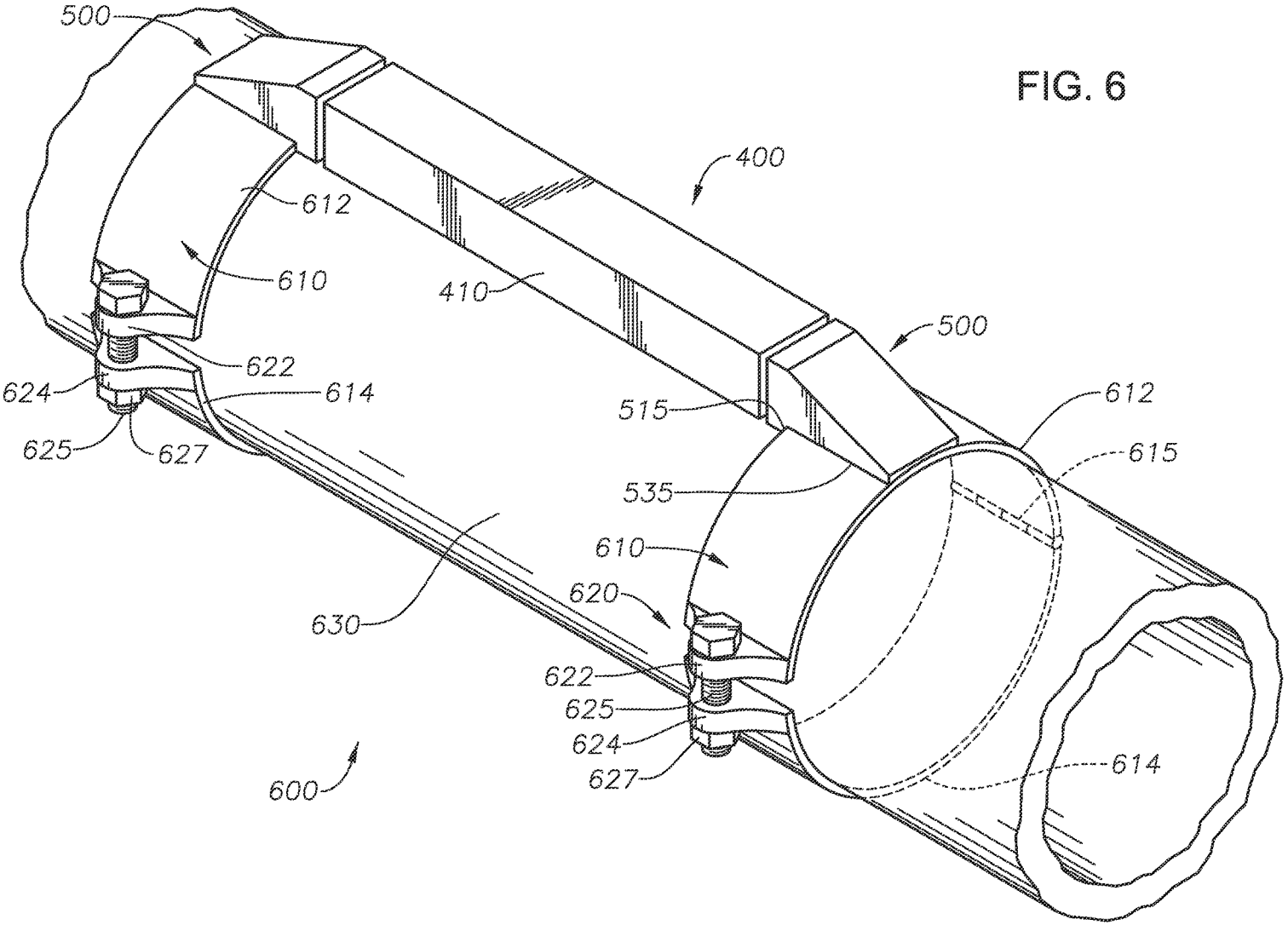
FIG. 6 is a perspective view of a portion of a communications node system of the present invention, in one embodiment. The illustrative communications node system utilizes a pair of clamps for connecting a communications node onto a tubular body.

FIG. 6 is a perspective view of a portion of a communications node system 600 of the present invention, in one embodiment. The communications node system 600 utilizes a pair of clamps 610 for mechanically connecting a communications node 400 onto a tubular body 630.

The system 600 first includes at least one clamp 610. In the arrangement of FIG. 6, a pair of clamps 610 is used. Each clamp 610 abuts the shoulder 515 of a respective shoe 500. Further, each clamp 610 receives the base 535 of a shoe 500. In this arrangement, the base 535 of each shoe 500 is welded onto an outer surface of the clamp 610. In this way, the clamps 610 and the communications node 400 become an integral tool.

The illustrative clamps 610 of FIG. 6 include two arcuate sections 612, 614. The two sections 612, 614 pivot relative to one another by means of a hinge. Hinges are shown in phantom at 615. In this way, the clamps 610 may be selectively opened and closed.

Each clamp 610 also includes a fastening mechanism 620. The fastening mechanisms 620 may be any means used for mechanically securing a ring onto a tubular body, such as a hook or a threaded connector. In the arrangement of FIG. 6, the fastening mechanism is a threaded bolt 625. The bolt 625 is received through a pair of rings 622, 624. The first ring 622 resides at an end of the first section 612 of the clamp 610, while the second ring 624 resides at an end of the second section 614 of the clamp 610. The threaded bolt 625 may be tightened by using, for example, one or more washers (not shown) and threaded nuts 627.

In operation, a clamp 610 is placed onto the tubular body 630 by pivoting the first 612 and second 614 arcuate sections of the clamp 610 into an open position. The first 612 and second 614 sections are then closed around the tubular body 630, and the bolt 625 is run through the first 622 and second 624 receiving rings. The bolt 625 is then turned relative to the nut 627 in order to tighten the clamp 610 and connected communications node 400 onto the outer surface of the tubular body 630. Where two clamps 610 are used, this process is repeated.

The tubular body 630 may be, for example, a string of casing, such as the casing string 130 of FIG. 1A. The wall 412 of the communications node 400 is ideally fabricated from a steel material having a resonance frequency compatible with the resonance frequency of the tubular body 630. In addition, the mechanical resonance of the wall 412 is at a frequency contained within the frequency band used for telemetry.

In one aspect, the communications node 400 is about 12 to 16 inches (0.30 to 0.41 meters) in length as it resides along the tubular body 630. Specifically, the housing 410 of the communications node may be (0.20 to 0.25 meters) in length, and each opposing shoe 500 may be 2 to 5 inches (0.05 to 0.13 meters) in length. Further, the communications node 400 may be about 1 inch in width and 1 inch in height. The housing 410 of the communications node 400 may have a concave profile that generally matches the radius of the tubular body 630.

A method for transmitting data in a wellbore is also provided herein. The method preferably employs the communications node 400 and the clamps 610 of FIG. 6.

Figure 7:
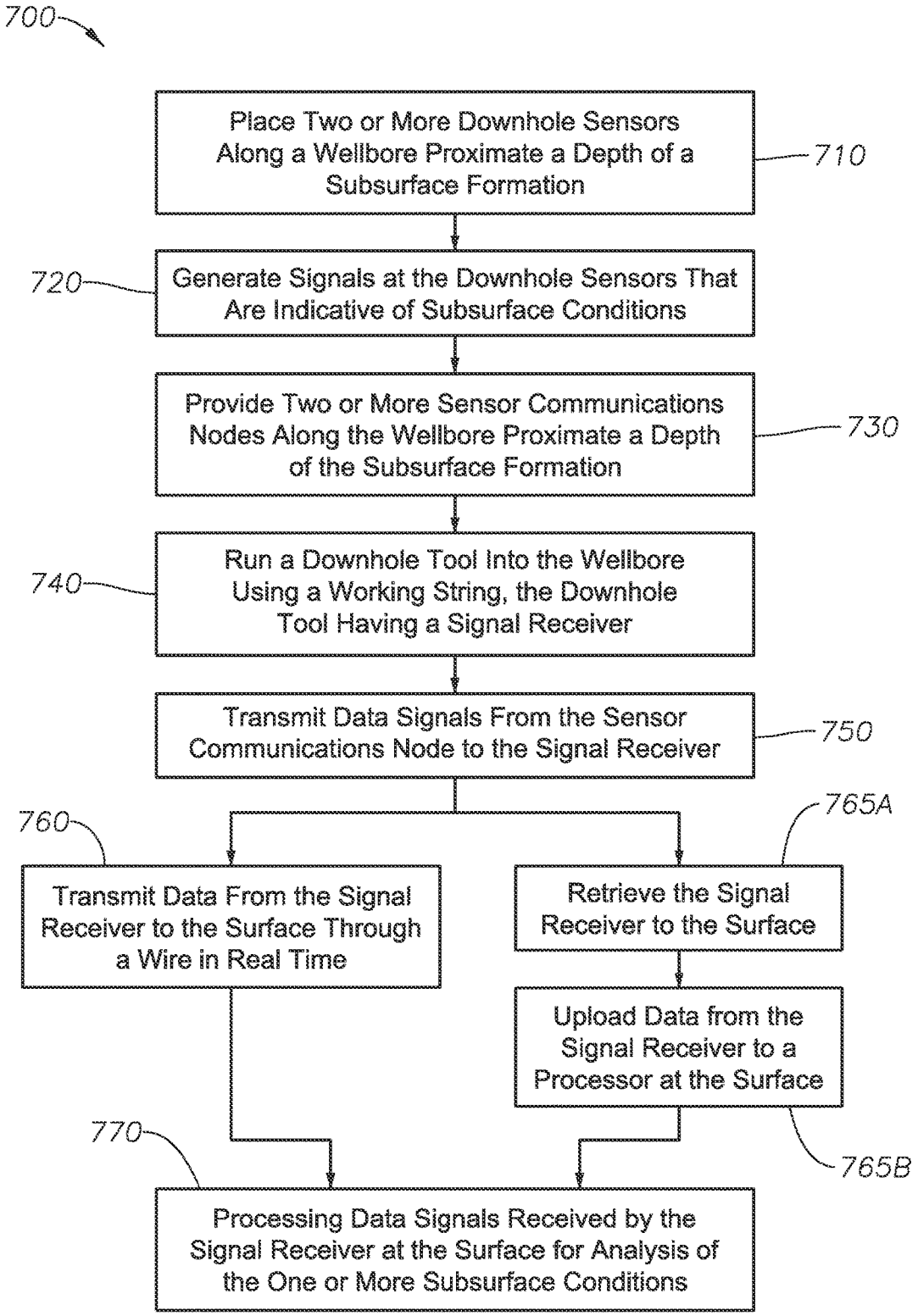
FIG. 7 is a flowchart demonstrating steps of a method for transmitting data in a wellbore in accordance with the present inventions, in one embodiment.

FIG. 7 provides a flow chart for a method 700 of transmitting date in a wellbore. The method 700 uses a plurality of communications nodes situated along a tubular body to accomplish a hybrid wired-and-wireless transmission of data along the wellbore. The wellbore penetrates into a subsurface formation, allowing for the communication of a wellbore condition at the depth of the subsurface formation up to the surface. Preferably, the wellbore includes an extended horizontal portion, with each of the communications nodes residing along the horizontal portion.

The method 700 first includes placing two or more downhole sensors along the wellbore. This is shown at Box 710. The sensors are placed proximate a depth of the subsurface formation. The sensors may be, for example, pressure sensors, temperature sensors, formation logging tools, microphones or casing strain gauges.

The method 700 also includes generating signals at the downhole sensors. This is provided at Box 720. The signals are indicative of subsurface conditions.

The method 700 further includes providing two or more sensor communications nodes along the wellbore. This is indicated at Box 730. The sensor communications nodes are also placed proximate a depth of the subsurface formation. Preferably, the sensors from step 710 reside within a housing of an associated sensor communications node. Also, the sensor communications nodes are preferably clamped to an outer surface of a string of production casing.

Each of the sensor communications nodes has an independent power source. The independent power source may be, for example, batteries or a fuel cell. In addition, each of the communications nodes optionally has an electro-acoustic transducer for converting electrical signals from the sensors into acoustic signals, or waves. Preferably, a frequency for the acoustic waves is selected that is between about 100 kHz and 125 kHz to more closely match the anticipated resonance frequency of the pipe material itself.

Each sensor communications node also has a transmitter or a transceiver for transmitting data. The data corresponds to the generated signals, as data signals. The data is sent wirelessly.

The method 700 additionally includes running a downhole tool into the wellbore. This is indicated at Box 740. The tool is run into the wellbore using a working string. The working string may be a coiled tubing string, a jointed working string, a slick line or an electric line.

The downhole tool includes an associated signal receiver. The signal receiver is configured to receive the data signals from the various sensor communications nodes as the downhole tool passes the nodes. In one aspect, the sensor communications nodes transmit acoustic signals to intermediate communications nodes, which then transmit signals node-to-node up to a receiver communications node. The signal receiver is then configured to receive the data signals from the receiver communications node(s).

In this arrangement, the intermediate communications nodes are configured to transmit signals indicative of the subsurface conditions acoustically. In one aspect, piezo wafers or other piezoelectric elements are used to transmit the acoustic signals. In another aspect, multiple stacks of piezoelectric crystals or other magnetostrictive devices are used. Signals are created by applying electrical signals of a designated frequency across one or more piezoelectric crystals, causing them to vibrate at a rate corresponding to the frequency of the desired acoustic signal.

In one aspect, the data transmitted between the intermediate communications nodes is represented by acoustic waves according to a multiple frequency shift keying (MFSK) modulation method. Although MFSK is well-suited for this application, its use as an example is not intended to be limiting. It is known that various alternative forms of digital data modulation are available, for example, frequency shift keying (FSK), multi-frequency signaling (MF), phase shift keying (PSK), pulse position modulation (PPM), and on-off keying (OOK). In one embodiment, every 4 bits of data are represented by selecting one out of sixteen possible tones for broadcast.

Acoustic telemetry along tubulars is characterized by multi-path or reverberation which persists for a period of milliseconds. As a result, a transmitted tone of a few milliseconds duration determines the dominant received frequency for a time period of additional milliseconds. Preferably, the communication nodes determine the transmitted frequency by receiving or "listening to" the acoustic waves for a time period corresponding to the reverberation time, which is typically much longer than the transmission time. The tone duration should be long enough that the frequency spectrum of the tone burst has negligible energy at the frequencies of neighboring tones, and the listening time must be long enough for the multipath to become substantially reduced in amplitude. In one embodiment, the tone duration is 2 ms, then the transmitter remains silent for 48 milliseconds before sending the next tone. The receiver, however, listens for 2+48=50 ms to determine each transmitted frequency, utilizing the long reverberation time to make the frequency determination more certain. Beneficially, the energy required to transmit data is reduced by transmitting for a short period of time and exploiting the multi-path to extend the listening time during which the transmitted frequency may be detected.

In one embodiment, an MFSK modulation is employed where each tone is selected from an alphabet of 16 tones, so that it represents 4 bits of information. With a listening time of 50 ms, for example, the data rate is 80 bits per second.

The tones are selected to be within a frequency band where the signal is detectable above ambient and electronic noise at least two nodes away from the transmitter node so that if one node fails, it can be bypassed by transmitting data directly between its nearest neighbors above and below. In one example the tones are evenly spaced in period within a frequency band from about 50 kHz to 500 kHz.

In one aspect, the electro-acoustic transceivers in the sensor communications nodes receive acoustic waves at a first frequency, and re-transmit the acoustic waves at a second different frequency. The electro-acoustic transceivers listen for the acoustic waves generated at the first frequency for a longer time than the time for which the acoustic waves were generated at the first frequency by a previous communications node.

The method also includes receiving data from the signal receiver at the surface. This is provided at Box 750. The data is indicative of one or more sensed subsurface conditions. For a land-based operation, the surface is an earth surface, preferably at or near the well lead. For an offshore operation, the surface may be a production platform, a drilling rig, a floating ship-shaped vessel, or an FPSO.

In one embodiment, the working string is an electric line, while the downhole tool is a perforating gun that is run into the wellbore on the electric line. In this instance, transmitting data signals from the sensor communications nodes to the signal receiver comprises transmitting data signals in connection with a zone being perforated. In addition, receiving data from the signal receiver at the surface comprises receiving data through the electric line in real time. In this instance, the sensors may be, for example, microphones. Such an embodiment is disclosed in Box 760, where data signals are transmitted to the surface in real time.

In another embodiment, the working string is a coiled tubing, while the downhole tool is a nozzle at an end of the coiled tubing. In this instance, transmitting data signals from the sensor communications nodes to the signal receiver comprises transmitting data signals in connection with a zone receiving an injection of fracturing fluid or an injection of an acid. In addition, receiving data from the signal receiver at the surface comprises spooling the coiled tubing to the surface, retrieving the signal receiver, and uploading data from the signal receiver to a micro-processor. Such an embodiment is disclosed in Boxes 765A, where the coiled tubing string (or other working string is spooled or pulled to the surface.

Data from the signal receiver is then uploaded to a process for analysis. This is shown at Box 765B. This enables an operator to monitor, for example, where frac sand (proppant) is going, and knowing whether or not new fractures have intercepted previously created fractures in a neighboring zone. Alternatively, this enables an operator to monitor a flow of acid through perforations.

The method 700 also provides for processing data signals received by the signal receiver. This is indicated at Box 770. The receiver has data acquisition capabilities. The receiver may employ either volatile or non-volatile memory. The signals are processed for analysis of the one or more subsurface conditions. Analysis may be by an operator, by software, or both.

It is noted that the method 700 may involve the use of intermediate communications nodes along at least one zone, such as nodes 172 shown along Zone 107 in FIG. 1. In this instance, the method will include:

transmitting data from a sensor communications node up the wellbore through a series of intermediate communications nodes and to a receiver communications node using acoustic signals, the data being indicative of the subsurface conditions;

transmitting data from the receiver communications node to the signal receiver; and repeating either the step of Box 760 or the steps of Boxes 765A and 765B to deliver data to the surface for the step of Box 770.

It is also observed that the operator may wish to retrieve data from the sensor communications nodes at a subsequent point after production operations have commenced. In this instance, the method 700 may further include:

beginning production operations;

running a battery recharging device into the wellbore, the battery recharging device emitting a signal to recharge a batter; and approaching (and preferably crossing) each sensor communications node such that the sensor communications nodes each receive the recharging signal.

In one aspect, the network can be put into a low-power "sleep mode" to preserve battery life while the network is inactive. When sensor data is desired after production operations have commenced, the network can be awoken, queried for data, and then put back to sleep until the next data acquisition period.

As can be seen, a novel downhole telemetry system is provided, as well as a novel method for the electro-acoustic transmission of information using a plurality of data transmission nodes. While it will be apparent that the inventions herein described are well calculated to achieve the benefits and advantages set forth above, it will be appreciated that the inventions are susceptible to modification, variation and change without departing from the spirit thereof.

What is claimed is:

1. A method of transmitting data along a wellbore up to a surface, comprising:

placing two or more downhole sensors engaged with a tubular positioned within the wellbore, the two or more sensors proximate a depth of a subsurface formation, the subsurface formation containing hydrocarbon fluids, the tubular extending between the surface and the subsurface formation within the wellbore;

generating sensor signals at the downhole sensors that are indicative of one or more subsurface conditions;

providing one or more sensor communications nodes along the tubular proximate the subsurface formation, each of the one or more sensor communications nodes having an acoustic transceiver in acoustic contact with the tubular for transmitting and receiving acoustic signals along the tubular for transmitting the data corresponding to the generated sensor signals as acoustic data signals along the tubular, wherein each sensor of the downhole sensors and said each sensor communications node of the one or more sensor communications nodes is secured to a joint of production casing, to a base pipe of a sand screen, or to a sliding sleeve device;

configuring the one or more sensor communications nodes to receive the generated sensor signals and transforming the received generated sensor signals into the acoustic data signals;

acoustically transmitting the acoustic data signals along the tubular using at least one of the one or more sensor communications nodes;

providing a memory node comprising a memory, the memory node in communication with the at least one of the one or more sensor communications nodes to retain the acoustic data signals in the memory, the memory being accessible to a memory wireless transmission transceiver;

running a downhole tool into the tubular using a working string, the downhole tool having an associated signal receiver;

transmitting the acoustic data signals from the memory to the associated signal receiver by means of the memory wireless transmission transceiver as the associated signal receiver is positioned by the working string within an effective wireless transmission range to said each of the sensor communications nodes within the wellbore;

transmitting the acoustic data signals received by the associated signal receiver from the memory along the working string to the surface; and receiving the acoustic data signals from the associated signal receiver at the surface;

further comprising a plurality of intermediate communications nodes, wherein at least one intermediate communications node of the intermediate communications nodes intermediately positioned between one of the one or more sensor communication nodes and the memory to transmit the acoustic data signals acoustically between the one of the one or more sensor communication nodes and the memory;

wherein an intermediate transceiver in each of the intermediate communications nodes receives acoustic waves at a first frequency, and re-transmits the acoustic waves to a next intermediate communications node at a second different frequency; and the intermediate transceiver in said at least one intermediate communications node listens for the acoustic waves generated at the first frequency for a longer time than the time for which the acoustic waves were generated at the first frequency by a previous intermediate communications node.

2. The method of claim 1, wherein the surface is an earth surface, or a water surface.

3. The method of claim 1, wherein: the downhole sensors are (i) pressure sensors, (ii) temperature sensors, (iii) induction logs, (iv) gamma ray logs, (v) formation density sensors, (vi) sonic velocity sensors, (vii) vibration sensors, (viii) resistivity sensors, (ix) flow meters, (x) microphones, (xi) geophones, (xii) strain gauges, or (xiii) combinations thereof.

4. The method of claim 3, wherein:

the working string comprises at least one of a slick line, an electric line, a string of coiled tubing, and another jointed tubular string; and a wireless transmission of the acoustic data signals is by radio waves, inductive electro-magnetic waves, ZigBee, Wi-Fi, acoustic, or optic waves.

5. The method of claim 3, wherein the effective wireless transmission range is between 0.1 and 25 feet (0.03 and 7.6 meters).

6. The method of claim 5, wherein the effective wireless transmission range occurs as the downhole tool crosses said each sensor communications node of the sensor communication nodes in the tubular.

7. The method of claim 5, wherein:

the working string is an electric line;

the downhole tool includes a perforating gun that is run into the tubular on the electric line;

said transmitting the acoustic data signals from the sensor communications nodes to the signal receiver comprises transmitting the acoustic data signals in connection with a zone being perforated; and said receiving the acoustic data signals from the signal receiver at the surface comprises receiving the acoustic data signals through the electric line in real time.

8. The method of claim 5, wherein:

the working string is coiled tubing;

the downhole tool is a nozzle at an end of the coiled tubing;

said transmitting the acoustic data signals from the sensor communications nodes to the signal receiver comprises transmitting the acoustic data signals in connection with a zone receiving an injection of a fracturing fluid or an acid; and said receiving the acoustic data signals from the signal receiver at the surface comprises spooling the coiled tubing to the surface, retrieving the signal receiver, and uploading the acoustic data signals from the signal receiver to a micro-processor.

9. The method of claim 5, wherein:

the downhole tool is a logging tool that is run into the tubular on a line; and said transmitting the acoustic data signals from the sensor communications nodes to the signal receiver comprises transmitting the acoustic data signals in connection with a well logging operation.

10. The method of claim 9, wherein:

the working string is an electric line; and said receiving the acoustic data from the signal receiver at the surface comprises receiving the acoustic data signals through the electric line in real time.

11. The method of claim 9, wherein:

the working string is a slick line or coiled tubing; and said receiving the acoustic data signals from the signal receiver at the surface comprises spooling the working string to the surface, retrieving the signal receiver, and uploading the acoustic data signals from the signal receiver to a micro-processor.

12. The method of claim 5, wherein:

the working string is jointed pipe or coiled tubing;

the downhole tool is a full bore drift tool;

said transmitting the acoustic data signals from the sensor communications nodes to the signal receiver comprises transmitting the acoustic data signals indicative of drift; and said receiving the acoustic data signals from the signal receiver at the surface comprises raising the working string to the surface, retrieving the signal receiver, and uploading the acoustic data signals from the signal receiver to a micro-processor.

13. The method of claim 1, wherein:

the tubular has a horizontal portion extending along the subsurface formation;

the horizontal portion is divided into production zones; and a downhole sensor of the one or more downhole sensors and corresponding sensor communications node of the one or more sensor communication nodes are positioned on the tubular and placed within the production zones within the subsurface formation.

14. The method of claim 1, further comprising:

beginning production operations;

running a battery recharging device into the tubular, the battery recharging device emitting a signal to recharge a battery; and approaching said each sensor communications node with the battery recharging device such that the sensor communications nodes each receive the emitting signal.

15. The method of claim 1, wherein said each of the intermediate communications nodes comprises:

a housing having a sealed bore, with the housing being fabricated from a material having a resonance frequency;

an electro-acoustic transducer and the intermediate transceiver residing within the bore for transmitting the acoustic data signals from the one or more sensor communication nodes; and an independent power source residing within the bore providing power to the intermediate transceiver of said each of the intermediate communications nodes.

16. The method of claim 15, wherein said each of the two or more downhole sensors resides within the housing of said each sensor communications node.

17. The method of claim 16, wherein:

said each of the intermediate communications nodes further comprises at least one clamp for radially attaching said each of the intermediate communications nodes onto a first outer surface of a subsurface pipe;

the subsurface pipe represents a joint of casing, a joint of liner, a fracturing sleeve, or a base pipe of a joint of sand screen; and said at least one intermediate communications nodes along the tubular comprises clamping said each of the intermediate communications nodes to a second outer surface of the tubular.

18. The method of claim 17, wherein the at least one clamp comprises:

a first arcuate section;

a second arcuate section;

a hinge for pivotally connecting the first and second arcuate sections; and a fastening mechanism for securing the first and second arcuate sections around the first outer surface of the subsurface pipe.

19. The method of claim 15, wherein said each of the two or more downhole sensors resides adjacent the housing of said each sensor communications node, and is in electrical communication with the electro-acoustic transducer of said each of the intermediate communications nodes.

20. The method of claim 1, wherein:

the wellbore comprises a plurality of fracturing sleeves placed along designated zones; and each fracturing sleeve comprises an associated downhole sensor of the downhole sensors and associated sensor communications node of the sensor communications nodes.

21. The method of claim 1, further comprising:

processing the acoustic data signals received by the associated signal receiver at the surface for analysis of the one or more subsurface conditions.

22. The method of claim 1, wherein:

the at least one intermediate communications node represents a discrete series of at least three acoustic communications nodes; and the acoustic communications nodes in the discrete series of the at least three acoustic communications nodes are spaced apart at one node per joint of pipe.

23. The method of claim 1, wherein:

the tubular has a horizontal portion extending along the subsurface formation, within the wellbore;

the horizontal portion is divided into production zones; and a downhole sensor of the downhole sensors and corresponding sensor communications node of the sensor communications nodes are placed within each production zone.

24. A downhole acoustic telemetry system, comprising:

two or more downhole sensors residing along a wellbore proximate a depth of a subsurface formation, with of the two or more downhole sensors being configured to sense a subsurface condition and then send sensor signals indicative of the subsurface condition, and with each of the downhole sensors residing along a designated production zone within the wellbore;

one or more sensor communications nodes also residing along the wellbore proximate the subsurface formation, wherein said each sensor of the downhole sensors and each sensor communications node of the one or more sensor communications nodes is secured to the wellbore, a joint of production casing, to a base pipe of a sand screen, or to a sliding sleeve device, and wherein said each of the one or more sensor communications nodes comprises:

a first housing having a first sealed bore, with the first housing being fabricated from a material having a resonance frequency;

a first electro-acoustic transducer and associated first transceiver residing within the first sealed bore for transmitting the sensor signals from the downhole sensors as acoustic signals, an independent power source residing within the first sealed bore providing power to the first transceiver;

said each of the one or more sensor communications nodes having a first acoustic transceiver in acoustic contact with the tubular for transmitting and receiving the acoustic signals along the tubular for transmitting data corresponding to the sensor signals as acoustic data signals along the tubular;

configuring the one or more sensor communications nodes to receive the sensor signals and transforming the received sensor signals into the acoustic data signals;

a series of intermediate communications nodes placed between the sensor communications nodes, each intermediate communications node of the intermediate communications nodes comprising:

a second housing having a second sealed bore, with the second housing being fabricated from a material having a resonance frequency;

a second electro-acoustic transducer and a second transceiver associated with, residing within the second sealed bore associated with said each intermediate communications node of the intermediate communications nodes, for transmitting the acoustic data signals along a subsurface pipe, node-to-node, said each of the intermediate communications nodes having said a second acoustic transceiver associated with, in acoustic contact with the tubular for transmitting and receiving the acoustic data signals along the tubular for transmitting the acoustic data signals corresponding to the sensor signals as the acoustic data signals along the tubular; and an independent power source residing within the second sealed bore associated with said each intermediate communications node, providing power to the said second transceiver associated with, residing within the second sealed bore associated with said each intermediate communications node;

a memory node comprising a memory, the memory node in communication with (i) the one or more sensor communications nodes and (ii) the series of intermediate communications nodes, to retain the acoustic data signals in the memory;

a receiver communications node along (i) and (ii), the receiver communications node being accessible to the memory, the receiver communications node including a communications node transceiver for wirelessly transmitting the acoustic data signals corresponding to electro-acoustic waves to a downhole signal receiver as the acoustic data signals;

wherein the downhole signal receiver is associated with a downhole tool configured to be run into the tubular using a working string;

wherein the acoustic data signals are transmitted from the memory to the downhole signal receiver by means of the receiver communications node as the downhole signal receiver is positioned by the working string within an effective wireless transmission range to said each of the sensor communications nodes within the wellbore; and wherein the acoustic data signals received by the downhole signal receiver are transmitted from the memory along the working string to a surface, where the acoustic data signals are received from the downhole signal receiver at the surface;

wherein the second transceiver in said each of the intermediate communications nodes receives the acoustic data signals at a first frequency, and re-transmits the acoustic data signals to a next intermediate communications node at a second different frequency; and the second transceiver in said each intermediate communications node listens for the acoustic data signals generated at the first frequency for a longer time than the time for which the acoustic data signals were generated at the first frequency by a previous intermediate communications node of the intermediate communications nodes.

25. The acoustic telemetry system of claim 24, wherein the downhole sensors are (i) pressure sensors, (ii) temperature sensors, (iii) induction logs, (iv) gamma ray logs, (v) formation density sensors, (vi) sonic velocity sensors, (vii) vibration sensors, (viii) resistivity sensors, (ix) flow meters, (x) microphones, (xi) geophones, (xii) strain gauges, or (xiii) combinations thereof.

26. The acoustic telemetry system of claim 25, wherein said each of the two or more downhole sensors resides within the first housing of said each sensor communications node.

27. The acoustic telemetry system of claim 25, wherein said each of the two or more downhole sensors resides adjacent the first housing of said each sensor communications node, and is in electrical communication with a corresponding first electro-acoustic transducer.

28. The acoustic telemetry system of claim 25, wherein said each sensor communications node transmits the acoustic data signals to said each intermediate communications node (i) by means of an insulated wire, or (ii) by the electro-acoustic waves using the subsurface pipe as an acoustic carrier medium.

29. The acoustic telemetry system of claim 25, wherein a frequency band for the acoustic data signals operates from 350 kHz to 500 kHz.

30. The acoustic telemetry system of claim 24, wherein at least one of the sensor communications nodes comprises the memory node.

31. The acoustic telemetry system of claim 24, wherein at least one of the intermediate communications nodes comprise the memory node.

32. The acoustic telemetry system of claim 24, wherein:

the working string comprises at least one of a slick line, an electric line, a string of coiled tubing, and another jointed tubular string; and a wireless transmission of the acoustic data signals is by radio waves, inductive electro-magnetic waves, ZigBee, Wi-Fi, acoustic, or optic waves.

33. The acoustic telemetry system of claim 24, wherein the effective wireless transmission range is between 0.1 and 25 feet (0.03 and 7.6 meters).

34. The acoustic telemetry system of claim 24, wherein a wireless transmission occurs as the downhole tool crosses said each sensor communications node in the tubular.

35. The acoustic telemetry system of claim 24, wherein:

the working string is an electric line;

the downhole tool includes a perforating gun that is run into the tubular on the electric line;

wherein said transmitting the acoustic data signals to the downhole signal receiver comprises transmitting the acoustic data signals in connection with a zone being perforated; and wherein said receiving the acoustic data signals from the downhole signal receiver at the surface comprises receiving the acoustic data signals through the electric line in real time.

36. The acoustic telemetry system of claim 24, wherein:

the working string is coiled tubing; and the downhole tool is a nozzle at an end of the coiled tubing;

wherein said transmitting the acoustic data signals to the downhole signal receiver comprises transmitting the acoustic data signals in connection with a zone receiving an injection of a fracturing fluid or an acid; and wherein said receiving the acoustic data signals from the signal receiver at the surface comprises spooling the coiled tubing to the surface, retrieving the downhole signal receiver, and uploading the acoustic data signals from the downhole signal receiver to a micro-processor.

37. The acoustic telemetry system of claim 24, wherein:

the downhole tool is a logging tool that is run into the tubular on a line; and wherein said transmitting the acoustic data signals to the downhole signal receiver comprises transmitting the acoustic data signals in connection with a well logging operation.

38. The acoustic telemetry system of claim 37, wherein:

the working string is an electric line; and said receiving the acoustic data signals from the downhole signal receiver at the surface comprises receiving the acoustic data signals through the electric line in real time.

39. The acoustic telemetry system of claim 37, wherein:

the working string is a slick line or coiled tubing; and wherein said receiving the acoustic data signals from the downhole signal receiver at the surface comprises spooling the working string to the surface, retrieving the downhole signal receiver, and uploading the acoustic data signals from the downhole signal receiver to a micro-processor.

40. The acoustic telemetry system of claim 24, wherein:

the working string is jointed pipe or coiled tubing;

The downhole tool is a full bore drift tool;

wherein said transmitting the acoustic data signals to the downhole signal receiver comprises transmitting the acoustic data signals indicative of drift; and wherein said receiving the acoustic data signals from the downhole signal receiver at the surface comprises raising the working string to the surface, retrieving the downhole signal receiver, and uploading the acoustic data signals from the downhole signal receiver to a micro-processor.

* * * * *